US012270581B2

(12) United States Patent
Onaka et al.

(10) Patent No.: US 12,270,581 B2
(45) Date of Patent: Apr. 8, 2025

(54) REFRIGERANT DISTRIBUTOR, HEAT EXCHANGER, AND AIR-CONDITIONING APPARATUS

(71) Applicant: Mitsubishi Electric Corporation, Tokyo (JP)

(72) Inventors: Yoji Onaka, Tokyo (JP); Takashi Matsumoto, Tokyo (JP); Rihito Adachi, Tokyo (JP); Tetsuji Saikusa, Tokyo (JP); Yuki Nakao, Tokyo (JP); Hiroyuki Morimoto, Tokyo (JP); Atsushi Kibe, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 283 days.

(21) Appl. No.: 17/918,237

(22) PCT Filed: May 19, 2021

(86) PCT No.: PCT/JP2021/018888
§ 371 (c)(1),
(2) Date: Oct. 11, 2022

(87) PCT Pub. No.: WO2021/235463
PCT Pub. Date: Nov. 25, 2021

(65) Prior Publication Data

US 2023/0146747 A1 May 11, 2023

(30) Foreign Application Priority Data

May 22, 2020 (WO) ..... PCT/JP2020/020352

(51) Int. Cl.
*F25B 39/02* (2006.01)
*F28F 9/02* (2006.01)
*F28D 21/00* (2006.01)

(52) U.S. Cl.
CPC ..... *F25B 39/028* (2013.01); *F28F 9/0273* (2013.01); *F28D 2021/0068* (2013.01)

(58) Field of Classification Search
CPC ..... F28F 9/0273; F25B 39/028
See application file for complete search history.

(56) References Cited

U.S. PATENT DOCUMENTS

2005/0132744 A1* 6/2005 Rohrer ..... F28F 9/0273 62/515
2010/0089559 A1 4/2010 Gorbounov et al.
(Continued)

FOREIGN PATENT DOCUMENTS

CN 101782297 A * 7/2010
JP H08-086591 A 4/1996
(Continued)

OTHER PUBLICATIONS

International Search Report of the International Searching Authority mailed Jul. 21, 2020 for the corresponding International application No. PCT/JP2020/020352 (and English translation).
(Continued)

*Primary Examiner* — Eric S Ruppert
(74) *Attorney, Agent, or Firm* — Posz Law Group, PLC

(57) ABSTRACT

A refrigerant distributor includes an outer pipe, an inner pipe, and a structural part. The refrigerant outflow hole is provided such that an angle θ between a lower end of the inner pipe on a vertical line passing through a center of the inner pipe and a position of presence of the refrigerant outflow hole as seen from the center of the inner pipe falls within a range of 10 degrees≤θ≤80 degrees. The refrigerant outflow hole comprises a sole refrigerant outflow hole provided in a vertical cross-section of the inner pipe at a position where the refrigerant outflow hole is provided.

11 Claims, 13 Drawing Sheets

(56) References Cited

U.S. PATENT DOCUMENTS

| | | | |
|---|---|---|---|
| 2011/0000255 | A1 | 1/2011 | Taras et al. |
| 2011/0203308 | A1 | 8/2011 | Chiang et al. |
| 2011/0203780 | A1 | 8/2011 | Jiang et al. |

FOREIGN PATENT DOCUMENTS

| | | | | | |
|---|---|---|---|---|---|
| JP | 2012-002475 | A | | 1/2012 | |
| WO | WO-2013180444 | A1 | * | 12/2013 | ..... F25B 41/00 |

OTHER PUBLICATIONS

International Search Report of the International Searching Authority mailed Jul. 13, 2021 for the corresponding International application No. PCT/JP2021/018888 (and English translation).
Extended European Search Report dated Oct. 16, 2023 issued in corresponding EP patent application No. 21808264.2.

* cited by examiner

REFRIGERANT DISTRIBUTOR, HEAT EXCHANGER, AND AIR-CONDITIONING APPARATUS

CROSS REFERENCE TO RELATED APPLICATIONS

This application is a U.S. national stage application of International Patent Application No. PCT/JP2021/018888 filed on May 19, 2021, which claims priority to International Patent Application No. PCT/JP2020/020352 filed on May 22, 2020, the contents of which are incorporated herein by reference.

TECHNICAL FIELD

The present disclosure relates to a double-channel refrigerant distributor including an inner pipe and an outer pipe, a heat exchanger, and an air-conditioning apparatus.

BACKGROUND ART

There has been known a refrigerant distributor configured to distribute refrigerant through the use of a double-channel pipe having an inner pipe and an outer pipe. Such a refrigerant distributor including a double-channel pipe has a refrigerant outflow hole (also called "orifice") provided in the lowermost part of the inner pipe. Refrigerant having flowed out through the refrigerant outflow hole is ejected into a space between the inner pipe and the outer pipe, flows into a heat transfer pipe through the outer pipe, and exchanges heat with air through the heat transfer pipe (see, for example, Patent Literature 1).

CITATION LIST

Patent Literature

Patent Literature 1: Japanese Unexamined Patent Application Publication No. 2012-2475

SUMMARY OF INVENTION

Technical Problem

However, in the related-art refrigerant distributor, for various reasons, the refrigerant hardly undergoes transition in flow condition to an annular flow, and regardless of annular drainage in a typical flow pattern map, there are imbalances in the distribution of a liquid phase across a vertical cross-section of the refrigerant distributor. Examples include a case in which a refrigerant inflow pipe is short, a case in which one heat exchanger is constituted by connecting a heat exchanger to a heat exchanger via a connecting pipe having a bend, or other cases. The related-art refrigerant distributor has suffered from imbalances in the distribution of refrigerant due to such imbalances in the distribution of a liquid phase.

The present disclosure was made under such circumferences, and has as an object to provide a refrigerant distributor configured to reduce imbalances in the distribution of a liquid phase across the refrigerant distributor and appropriately distribute refrigerant, a heat exchanger, and an air-conditioning apparatus.

Solution to Problem

A refrigerant distributor according to an embodiment of the present disclosure includes an outer pipe through which refrigerant flows and to which a plurality of heat transfer pipes are connected at predetermined spacing from each other, an inner pipe, housed in the outer pipe, through which the refrigerant flows and that has a refrigerant outflow hole through which the refrigerant flows out of the inner pipe into the outer pipe, and a structural part with which the inner pipe or the outer pipe is provided, in which the refrigerant enters an undeveloped state of two-phase gas-liquid flow, and through which the refrigerant flows into the inner pipe. The refrigerant outflow hole is provided such that an angle θ between a lower end of the inner pipe on a vertical line passing through a center of the inner pipe and a position of presence of the refrigerant outflow hole as seen from the center of the inner pipe falls within a range of 10 degrees≤θ≤80 degrees. The refrigerant outflow hole comprises a sole refrigerant outflow hole provided in a vertical cross-section of the inner pipe at a position where the refrigerant outflow hole is provided.

Advantageous Effects of Invention

The refrigerant distributor according to the embodiment of the present disclosure has an inner or outer pipe provided with a structural part in which refrigerant enters an undeveloped state of two-phase gas-liquid flow. The refrigerant having passed through the structural part flows into the inner pipe in an undeveloped state of two-phase gas-liquid flow. Only one refrigerant outflow hole is provided in a vertical cross-section of the inner pipe at a position where the refrigerant outflow hole is provided. The refrigerant outflow hole is provided such that an angle θ between a lower end of the inner pipe on a vertical line passing through the center of the inner pipe and the position of presence of the refrigerant outflow hole falls within a range of 10 degrees≤θ≤80 degrees. Therefore, the refrigerant outflow hole is provided only near the liquid surface of the refrigerant. This allows the refrigerant distributor to, even when the refrigerant flows into the inner pipe in an undeveloped state of two-phase gas-liquid flow, evenly distribute the refrigerant into a space formed between the inner pipe and the outer pipe, making it possible to appropriately distribute the refrigerant.

DESCRIPTION OF EMBODIMENTS

Figure 1:
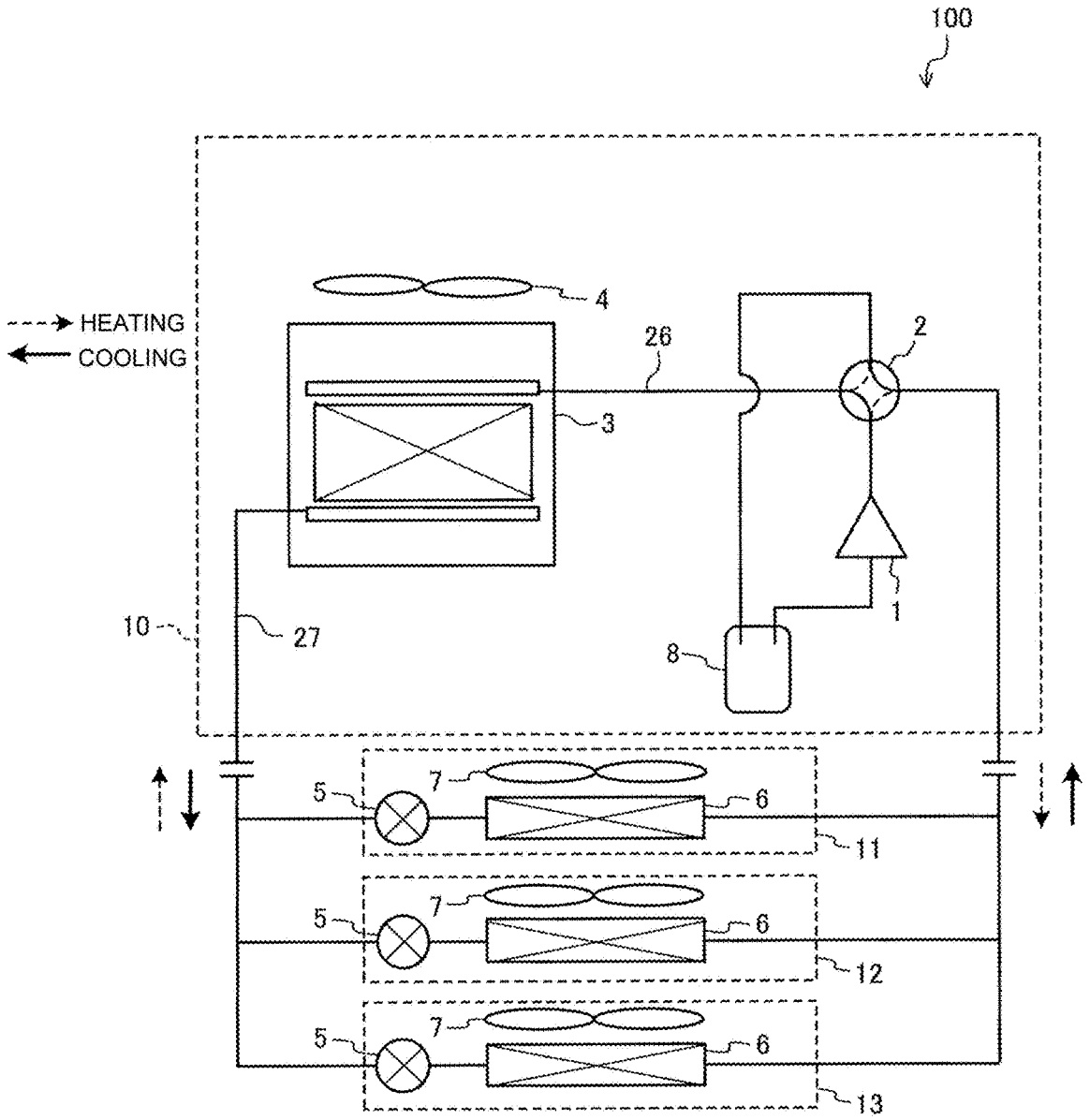
FIG. 1 is a refrigerant circuit diagram of an air-conditioning apparatus according to Embodiment 1.

The following describes, with reference to the drawings, an air-conditioning apparatus having a refrigerant distributor according to an embodiment. In the drawings, identical components are described with reference to identical signs, and a redundant description is given only when necessary. The present disclosure may encompass all combinations of components, described in any of the following embodiments that can be combined with each other.

Embodiment 1

<Air-Conditioning Apparatus 100>

FIG. 1 is a refrigerant circuit diagram of an air-conditioning apparatus 100 according to Embodiment 1. As shown in FIG. 1, the air-conditioning apparatus 100 includes an outdoor unit 10 and a plurality of indoor units 11, 12, and 13. The indoor units 11, 12, and 13 are connected in parallel to one another. Refrigerant circulates through the outdoor unit 10 and the plurality of indoor units 11, 12, and 13. The air-conditioning apparatus 100 is a variable refrigerant flow air-conditioning apparatus. It should be noted that Embodiment 1 is not intended to limit the number of indoor units 11, 12, and 13 that are connected to the outdoor unit 10.

The air-conditioning apparatus 100 has a refrigerant circuit in which a compressor 1, a four-way valve 2, an outdoor heat exchanger 3, expansion valves 5, indoor heat exchangers 6, and an accumulator 8 are connected to one another by a refrigerant pipe 26 and a refrigerant pipe 27. The outdoor heat exchanger 3 and each of the indoor heat exchangers 6 exchange heat between refrigerant and air flowing inside on the wind generated by a fan 4 and fans 7.

During cooling operation, high-temperature and high-pressure gas refrigerant compressed by the compressor 1 flows via the four-way valve 2 into the outdoor heat exchanger 3 through the refrigerant pipe 26, which connects the four-way valve 2 to the outdoor heat exchanger 3. After having flowed into the outdoor heat exchanger 3, the refrigerant exchanges heat with the wind generated by the fan 4 and then flows out through the refrigerant pipe 27, which connects the outdoor heat exchanger 3 to the expansion valves 5. In the case of heating operation, that is, in a case in which the outdoor heat exchanger 3 functions as an evaporator, the refrigerant flows in a direction opposite to that in which the refrigerant flows in a case in which the outdoor heat exchanger 3 functions as a condenser.

<Outdoor Heat Exchanger 3>

Figure 2:
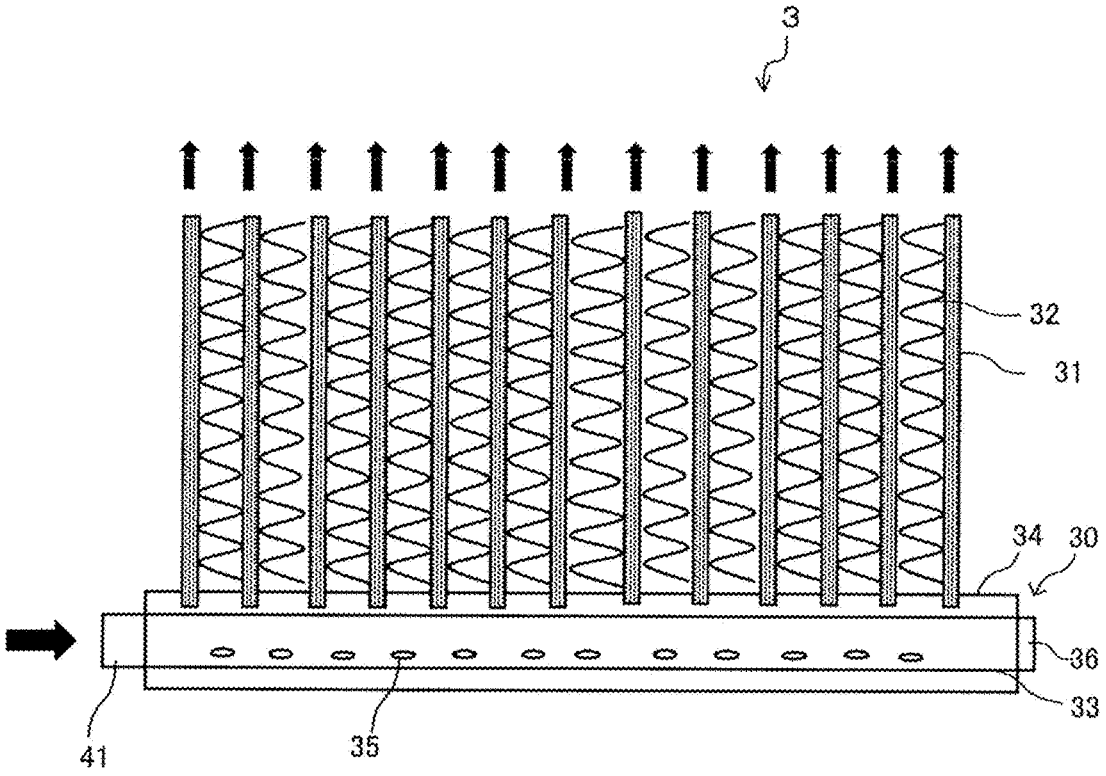
FIG. 2 is a side schematic view of an outdoor heat exchanger of the air-conditioning apparatus according to Embodiment 1.
Figure 3:
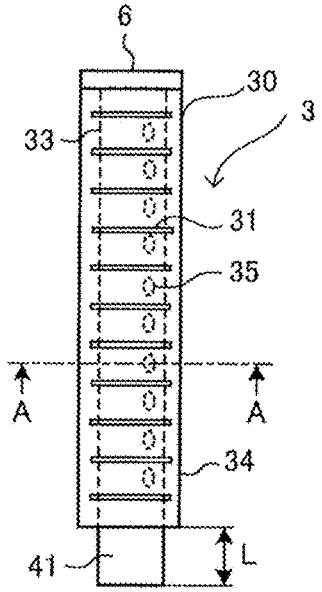
FIG. 3 is a top schematic view of the outdoor heat exchanger of the air-conditioning apparatus according to Embodiment 1.

FIG. 2 is a side schematic view of the outdoor heat exchanger 3 of the air-conditioning apparatus 100 according to Embodiment 1. FIG. 3 is a top schematic view of the outdoor heat exchanger 3 of the air-conditioning apparatus 100 according to Embodiment 1. The black arrows in FIG. 2 represent the flow of refrigerant in a case in which the outdoor heat exchanger 3 functions as an evaporator.

The outdoor heat exchanger 3, which is mounted in the outdoor unit 10 of the air-conditioning apparatus 100, causes heat exchange to be performed between the refrigerant and outside air sucked through an air inlet by the fan 4. The outdoor heat exchanger 3 is disposed below the fan 4.

As shown in FIG. 2, the outdoor heat exchanger 3 has a refrigerant distributor 30, a plurality of heat transfer pipes 31, and a plurality of fins 32. The refrigerant distributor 30 is disposed in a horizontal direction. The plurality of heat transfer pipes 31 are provided at spacings from each other, and each have one end inserted in the refrigerant distributor 30. The fins 32 are attached to the heat transfer pipes 31, and are provided between the heat transfer pipes 31. The fins 32 transfer heat to the heat transfer pipes 31.

<Refrigerant Distributor 30>

As shown in FIG. 2, the refrigerant distributor 30 is a double-pipe structure including an inner pipe 33 and an outer pipe 34. To the outer pipe 34, the plurality of heat transfer pipes 31 are connected in a direction of extension of the outer pipe 34. Refrigerant having flowed into a space between the inner pipe 33 and the outer pipe 34 is distributed to the plurality of heat transfer pipes 31.

The inner pipe 33 is kept horizontal in a direction of pipe extension. Refrigerant containing liquid refrigerant flows in through one end of the inner pipe 33. A cap 36 is provided at the furthest downstream end of the inner pipe 33 in the flow of refrigerant in a case in which the outdoor heat exchanger 3 functions as an evaporator. The refrigerant pipe 27 of the refrigeration cycle circuit is connected to the furthest upstream end of the inner pipe 33 in the flow of refrigerant in a case in which the outdoor heat exchanger 3 functions as an evaporator.

As shown in FIGS. 2 and 3, the inner pipe 33 has refrigerant outflow holes 35 (also called "orifices") formed therein at a spacing from each other in the direction of pipe extension of the inner pipe 33 and between the heat transfer pipes 31. Providing the refrigerant outflow holes 35 between the heat transfer pipes 31 makes it possible to bring about further improvement in refrigerant distribution performance of the refrigerant distributor 30 than in a case in which the refrigerant outflow holes 35 are provided in the inner pipe 33 directly below the heat transfer pipes 31. It should be noted that the refrigerant outflow holes 35 may be formed in the inner pipe 33 directly below the heat transfer pipes 31. Further, the inner pipe 33 is provided with a flow inlet 41. The flow inlet 41 has a length L as an entrance length. Assuming that D is the inside diameter of the inner pipe 33, L<5D holds.

Figure 4:
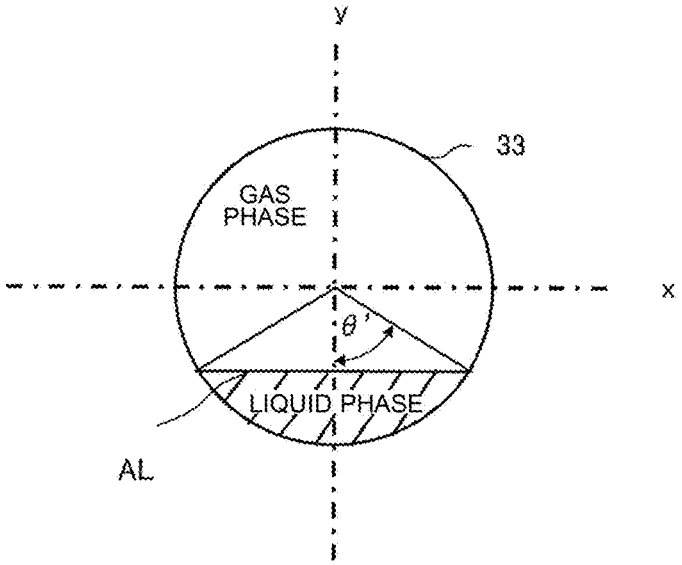
FIG. 4 is a diagram showing states of refrigerant in an inner pipe of the air-conditioning apparatus according to Embodiment 1.

FIG. 4 is a diagram showing states of refrigerant in the inner pipe 33 of the air-conditioning apparatus 100 according to Embodiment 1. As shown in FIG. 4, the refrigerant is present in two states, namely gas-phase refrigerant and liquid-phase refrigerant, in the inner pipe 33, which is a shower pipe. In Embodiment 1, the refrigerant outflow holes 35 are provided at around the angle θ' of the liquid surface AL of the liquid-phase refrigerant.

Figure 5:
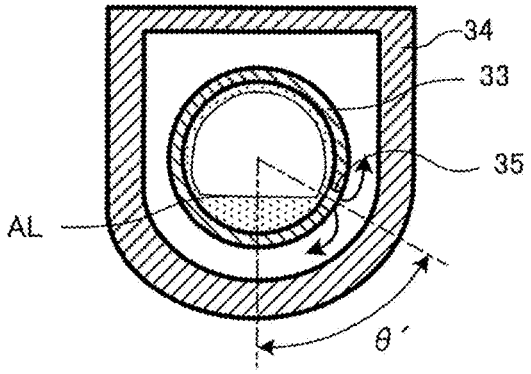
FIG. 5 is a vertical cross-sectional view of a refrigerant distributor of the air-conditioning apparatus according to Embodiment 1 as taken along line A-A in FIG. 3.

FIG. 5 is a vertical cross-sectional view of the refrigerant distributor 30 of the air-conditioning apparatus 100 according to Embodiment 1 as taken along line A-A in FIG. 3. FIG. 5 is a diagram showing a state where refrigerant is flowing in a state of semi-annular flow through the inner pipe 33. FIG. 5 shows an example in which a refrigerant outflow hole 35 is provided at the angle θ' of the liquid surface AL of the liquid-phase refrigerant.

The angle θ at which the refrigerant outflow hole 35 is provided, that is, the angle θ between a lower end of the inner pipe 33 on a vertical line passing through the center of the inner pipe 33 and the position of presence of the refrigerant outflow hole 35 as seen from the center of the inner pipe 33, needs only fall within the range of 10 degrees≤θ≤80 degrees.

More specifically, the angle at which the refrigerant outflow hole 35 is provided is determined by Formula (1). Formula (1) is a prediction formula, based on the Nusselt's liquid membrane estimation formula, in which results of experimentation conducted by the inventors are reflected.

[Math. 1]

$$\theta = (1.2393x^2 - 37.264x + 318.71)\left[\left(\frac{Ja^3 Ga}{Pr_L^3}\right)^{1/4} \frac{\nu_L L}{D^{3.5}}\right]^{0.142} \pm 20^\circ \quad (1)$$

where x is the distance of projection of the refrigerant outflow hole 35 onto a horizontal line orthogonal to a direction of pipe extension passing through the center of the inner pipe 33, Ja is the Jacob number, Ga is the Galileo number, $Pr_L$ is the liquid Prandtl number, $v_L$ is a coefficient of liquid kinematic viscosity, L is the entrance length of the inner pipe, D is the inside diameter of the inner pipe, $Ga=gD^3/v_L^2$, Ja=CpL/Δiv, CpL is the specific heat at constant pressure, Δiv is the latent heat, and L<5D.

The quantities of state and the values of physical properties are estimated by the pressure of inflow into the refrigerant distributor 30.

Figure 6:
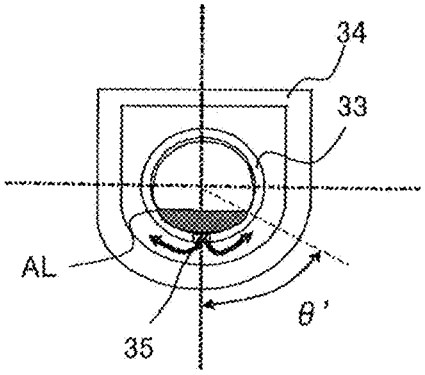
FIG. 6 is a vertical cross-sectional view, intended to explain the effects of the air-conditioning apparatus according to Embodiment 1 that shows a relationship between the liquid surface of refrigerant in the inner pipe and a refrigerant outflow hole.
Figure 7:
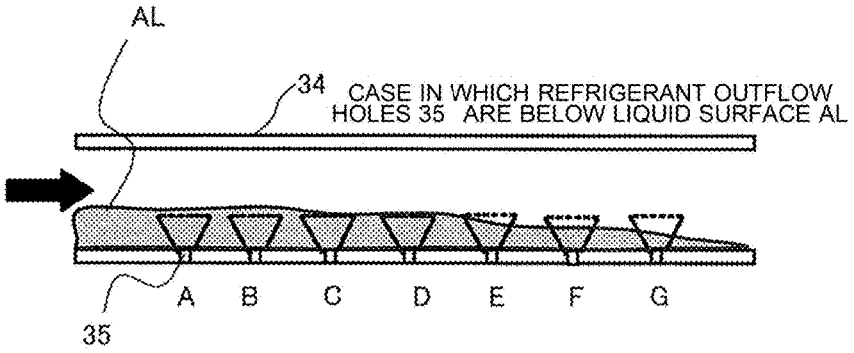
FIG. 7 is a diagram, intended to explain the effects of the air-conditioning apparatus according to Embodiment 1 that shows a range of influence of refrigerant outflow holes on the refrigerant and a flow condition of the refrigerant.
Figure 8:
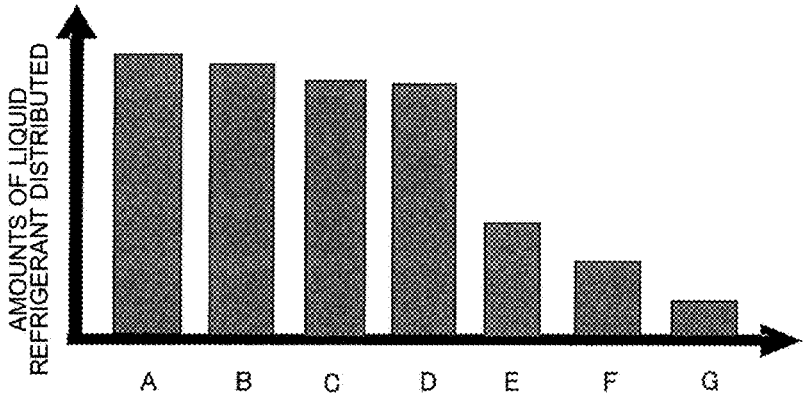
FIG. 8 is a diagram, intended to explain the effects of the air-conditioning apparatus according to Embodiment 1, that shows the characteristics of the amounts of refrigerant that are distributed in a case in which the refrigerant outflow holes are provided in a lower part of the inner pipe.

FIG. 6 is a vertical cross-sectional view, intended to explain the effects of the air-conditioning apparatus 100 according to Embodiment 1, that shows a relationship between the liquid surface AL of refrigerant in the inner pipe 33 and a refrigerant outflow hole 35. FIG. 6 shows a case in which the liquid phase of refrigerant flowing through the inner pipe 33 is a semi-annular flow, and also shows a case in which the refrigerant outflow hole 35 is provided in the lowermost part of the inner pipe 33. FIG. 7 is a diagram, intended to explain the effects of the air-conditioning apparatus 100 according to Embodiment 1 that shows a range of influence of refrigerant outflow holes 35 on the refrigerant and a flow condition of the refrigerant. FIG. 8 is a diagram, intended to explain the effects of the air-conditioning apparatus 100 according to Embodiment 1, that shows the characteristics of the amounts of refrigerant that are distributed in a case in which the refrigerant outflow holes 35 are provided in a lower part of the inner pipe 33.

In the case shown in FIGS. 7 and 8, as shown in FIG. 6 the refrigerant outflow holes 35 are provided in the lowermost part of the inner pipe 33. In FIGS. 7 and 8, the refrigerant outflow holes 35 are assigned sings A to G in alphabetical order by proximity to the flow inlet 41. In FIGS. 7 and 8, the dashed lines represent the range of influence of each separate refrigerant outflow hole 35, and at some point in time, refrigerant within the dashed lines passes through the refrigerant outflow holes 35 to be distributed. In a case in which the flow pattern of the refrigerant is a semi-annular flow, as shown in FIG. 8, the amounts of liquid refrigerant that are distributed to the upstream refrigerant outflow holes A to D are larger than the amounts of liquid refrigerant that are distributed to the downstream refrigerant outflow holes E to G.

Figure 9:
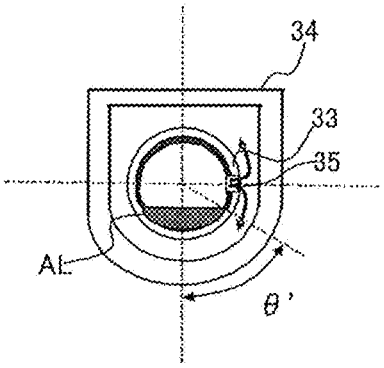
FIG. 9 is a vertical cross-sectional view, intended to explain the effects of the air-conditioning apparatus according to Embodiment 1 that shows a relationship between the liquid surface of refrigerant in the inner pipe and a refrigerant outflow hole.
Figure 10:
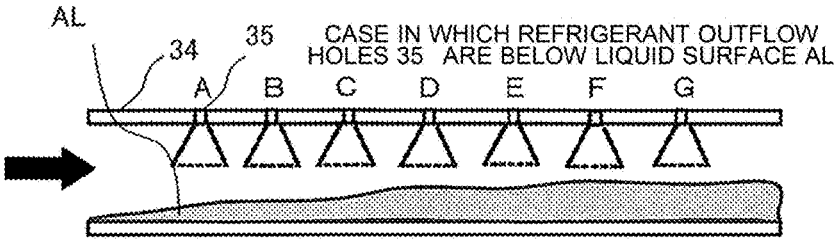
FIG. 10 is a diagram, intended to explain the effects of the air-conditioning apparatus according to Embodiment 1 that shows a range of influence of refrigerant outflow holes on the refrigerant and a flow condition of the refrigerant.
Figure 11:
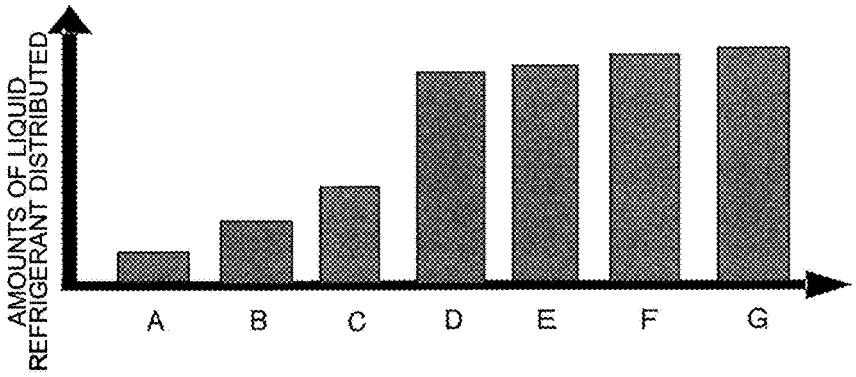
FIG. 11 is a diagram, intended to explain the effects of the air-conditioning apparatus according to Embodiment 1, that shows the characteristics of the amounts of refrigerant that are distributed in a case in which the refrigerant outflow holes are provided in an upper part of the inner pipe.

FIG. 9 is a vertical cross-sectional view, intended to explain the effects of the air-conditioning apparatus 100 according to Embodiment 1, that shows a relationship between the liquid surface AL of refrigerant in the inner pipe 33 and a refrigerant outflow hole 35. FIG. 9 shows a case in which the liquid phase of refrigerant flowing through the inner pipe 33 is a semi-annular flow, and also shows a case in which the refrigerant outflow hole 35 is provided at position θ=90 degrees in the inner pipe 33. That is, the refrigerant outflow hole 35 is located above the liquid surface AL. FIG. 10 is a diagram, intended to explain the effects of the air-conditioning apparatus 100 according to Embodiment 1 that shows a range of influence of refrigerant outflow holes 35 on the refrigerant and a flow condition of the refrigerant. FIG. 11 is a diagram, intended to explain the effects of the air-conditioning apparatus 100 according to Embodiment 1, that shows the characteristics of the amounts of refrigerant that are distributed in a case in which the refrigerant outflow holes 35 are provided in an upper part of the inner pipe 33. In the case shown in FIGS. 10 and 11, as shown in FIG. 9, the refrigerant outflow holes 35 are provided at position θ=90 degrees in the inner pipe 33. In a case in which the flow pattern of the refrigerant is a semi-annular flow, as shown in FIG. 11, the amounts of liquid refrigerant that are distributed to the upstream refrigerant outflow holes A to C are larger than the amounts of liquid refrigerant that are distributed to the downstream refrigerant outflow holes D to G.

Figure 12:
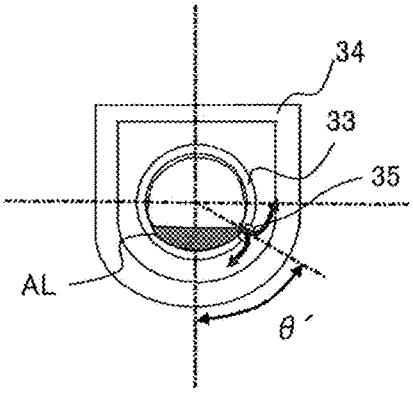
FIG. 12 is a vertical cross-sectional view showing a relationship between the liquid surface of refrigerant in the inner pipe and a refrigerant outflow hole in the air-conditioning apparatus according to Embodiment 1.
Figure 13:
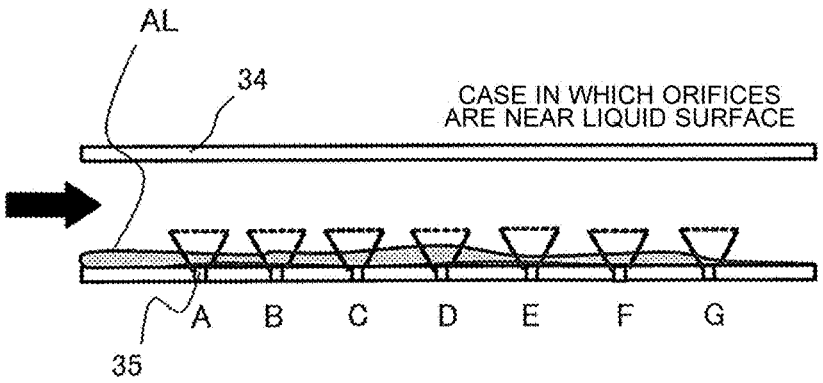
FIG. 13 is a diagram showing a range of influence of refrigerant outflow holes on the refrigerant and a flow condition of the refrigerant in the air-conditioning apparatus according to Embodiment 1.
Figure 14:
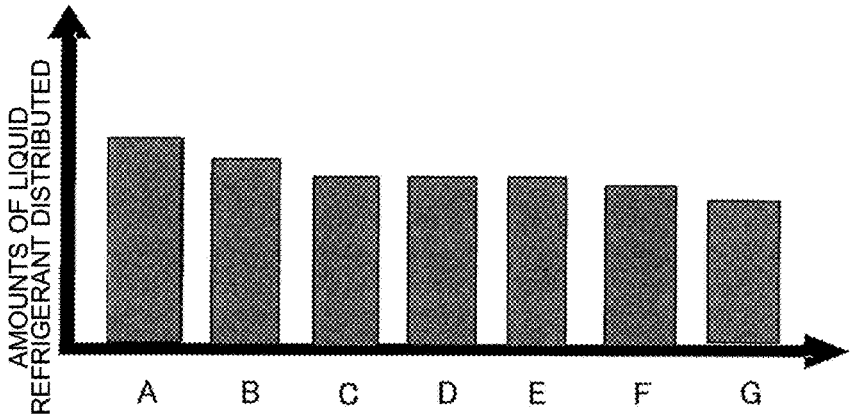
FIG. 14 is a diagram showing the characteristics of the amounts of refrigerant that are distributed in a case in which the refrigerant outflow holes are provided in the liquid surface in the inner pipe in the air-conditioning apparatus according to Embodiment 1.

FIG. 12 is a vertical cross-sectional view showing a relationship between the liquid surface AL of refrigerant in the inner pipe 33 and a refrigerant outflow hole 35 in the air-conditioning apparatus 100 according to Embodiment 1. FIG. 12 shows a case in which the liquid phase of refrigerant flowing through the inner pipe 33 is a semi-annular flow. In Embodiment 1, the refrigerant outflow hole 35 is provided near the liquid surface AL in the inner pipe 33. Only one refrigerant outflow hole 35 is provided in a vertical cross-section of the inner pipe 33. FIG. 13 is a diagram showing a range of influence of refrigerant outflow holes 35 on the refrigerant and a flow condition of the refrigerant in the air-conditioning apparatus 100 according to Embodiment 1. FIG. 14 is a diagram showing the characteristics of the amounts of refrigerant that are distributed in a case in which the refrigerant outflow holes 35 are provided in the liquid surface AL in the inner pipe 33 in the air-conditioning apparatus 100 according to Embodiment 1. In the case shown in FIGS. 13 and 14, as shown in FIG. 12, the refrigerant outflow holes 35 are provided at position of the liquid surface AL in the inner pipe 33. Even in a case in which the flow pattern of the refrigerant is a semi-annular flow, as shown in FIG. 14, the amounts of liquid refrigerant that are distributed to the refrigerant outflow holes A to G are evener than in FIGS. 8 and 11.

Therefore, in the air-conditioning apparatus 100 according to Embodiment 1, the refrigerant outflow holes 35 are provided near the liquid surface AL even in a case in which a sufficient entrance length cannot be ensured (L<5D). Thus, the air-conditioning apparatus 100 according to Embodiment 1 makes it possible to distribute gas and liquid relatively evenly to the space formed between the outer pipe 34 and the inner pipe 33. Therefore, the refrigerant distributor 30 can appropriately distribute refrigerant.

Embodiment 2

Embodiment 1 has illustrated the case of one outdoor heat exchanger 3. Embodiment 2 illustrates a case in which a first outdoor heat exchanger 3*a* and a second outdoor heat exchanger 3*b* are connected to each other by a bent inner pipe 33*r*.

Figure 15:
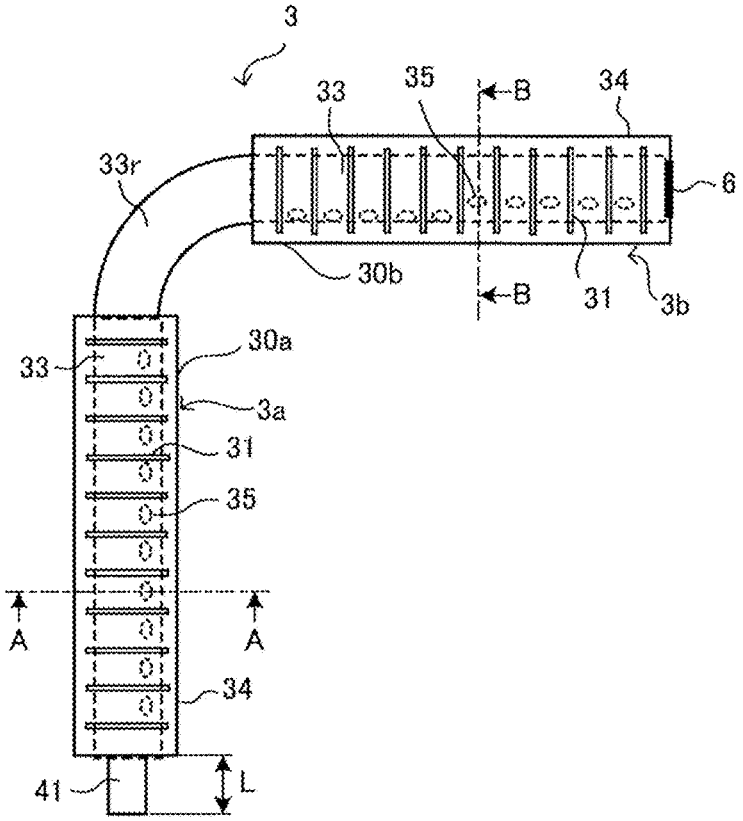
FIG. 15 is a top schematic view of an outdoor heat exchanger of an air-conditioning apparatus according to Embodiment 2.

FIG. 15 is a top schematic view of an outdoor heat exchanger 3 of an air-conditioning apparatus 100 according to Embodiment 2. As shown in FIG. 15, the outdoor heat exchanger 3 includes a first outdoor heat exchanger 3*a* and a second outdoor heat exchanger 3*b*. A first refrigerant distributor 30*a* of the first outdoor heat exchanger 3*a* and a second refrigerant distributor 30*b* of the second outdoor heat exchanger 3*b* are connected to each other by a bent inner pipe 33*r* having a bend having a curvature. The bent inner pipe 33*r* connects an inner pipe 33 of the first outdoor heat exchanger 3*a* to an inner pipe 33 of the second outdoor heat exchanger 3*b*.

Figure 16:
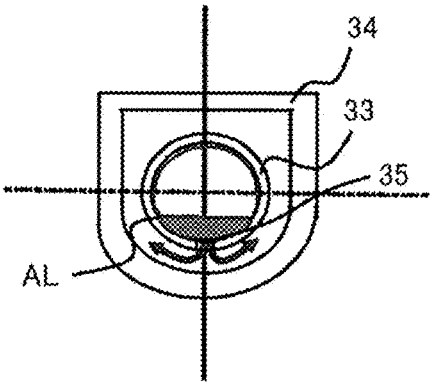
FIG. 16 is a vertical cross-sectional view of a refrigerant distributor of the air-conditioning apparatus according to Embodiment 2 as taken along line A-A in FIG. 15.

FIG. 16 is a vertical cross-sectional view of the first refrigerant distributor 30*a* of the air-conditioning apparatus 100 according to Embodiment 2 as taken along line A-A in FIG. 15. As shown in FIG. 16, the flow pattern of refrigerant flowing through the inner pipe 33 of the first refrigerant distributor 30*a* of the first outdoor heat exchanger 3*a* is a semi-annular flow. The angle θ1 of a refrigerant outflow hole 35 is for example θ1=0 degrees, which indicates the lowermost part of the inner pipe 33.

Figure 17:
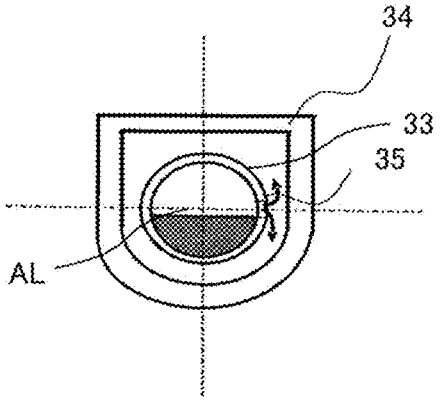
FIG. 17 is a vertical cross-sectional view of a refrigerant distributor of the air-conditioning apparatus according to Embodiment 2 as taken along line B-B in FIG. 15.

FIG. 17 is a vertical cross-sectional view of the first refrigerant distributor 30*a* of the air-conditioning apparatus 100 according to Embodiment 2 as taken along line B-B in FIG. 15. As shown in FIG. 17, the flow pattern of refrigerant flowing through the inner pipe 33 of the second refrigerant distributor 30*b* of the second outdoor heat exchanger 3*b* is a separated flow. The angle θ2 of a refrigerant outflow hole 35 is for example θ2=|45 degrees|, which indicates a horizontal direction orthogonal to a direction of pipe extension passing through the center of the inner pipe 33.

The angle θ2 of a refrigerant outflow hole 35 of the second refrigerant distributor 30*b* is larger within the range of −180 degrees to 180 degrees than the angle θ1 of a refrigerant outflow hole 35 of the first refrigerant distributor 30*a* (θ2>θ1).

In the air-conditioning apparatus 100 according to Embodiment 2, the flow pattern of refrigerant flowing through the inner pipe 33 of the first refrigerant distributor 30*a* before passing through the bent inner pipe 33*r* is a semi-annular flow. The flow pattern of refrigerant flowing through the inner pipe 33 of the second refrigerant distributor 30*b* after having passed through the bent inner pipe 33*r* is a separated flow. Therefore, as shown in FIG. 17, the liquid surface AL of the refrigerant rises, with the result that there is deterioration in refrigerant distribution performance. In Embodiment 2, the angle θ2 of a refrigerant outflow hole 35 of the second refrigerant distributor 30*b* is larger than the angle θ1 of a refrigerant outflow hole 35 of the first refrigerant distributor 30*a*. This makes it possible to bring about improvement in refrigerant distribution performance of the first and second refrigerant distributors 30*a* and 30*b*.

The bent inner pipe 33*r* may be an L-shaped pipe fitting (elbow), or may be one formed by bending an outer pipe 34 of the first refrigerant distributor 30*a*.

Embodiment 3

As with Embodiment 2 shown in FIG. 15, Embodiment 3 is configured such that an outdoor heat exchanger 3 includes a first outdoor heat exchanger 3*a* and a second outdoor heat exchanger 3*b*. In such a configuration of Embodiment 3, the second outdoor heat exchanger 3*b* has an inner pipe 33 whose diameter becomes smaller toward one terminal end.

Figure 18:
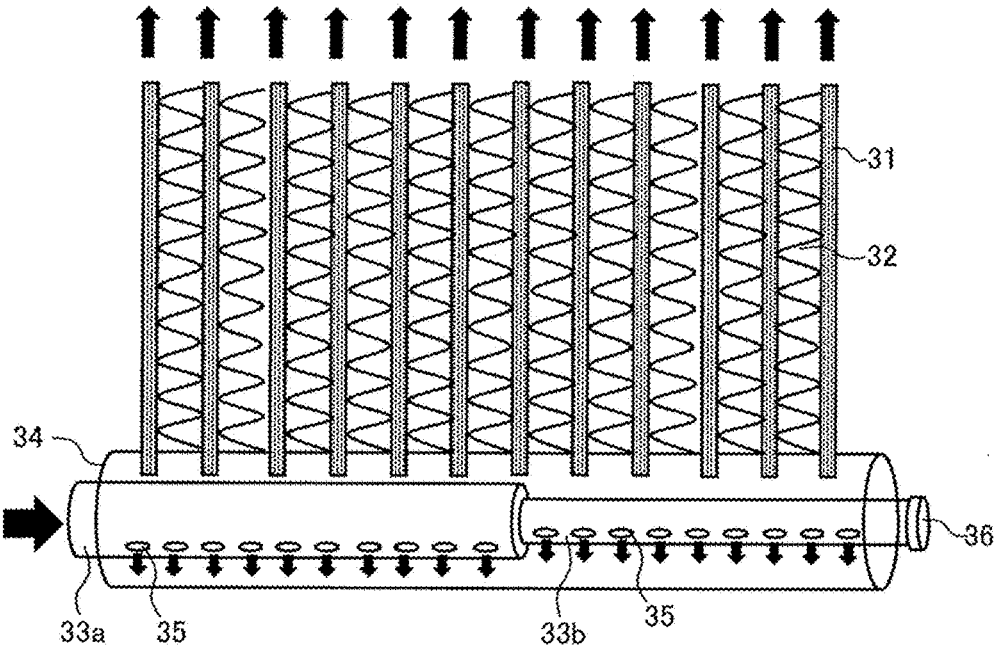
FIG. 18 is a side schematic view of a second outdoor heat exchanger of an air-conditioning apparatus according to Embodiment 3.

FIG. 18 is a side schematic view of a second outdoor heat exchanger 3*b* of an air-conditioning apparatus 100 according to Embodiment 3. As shown in FIG. 18, the second outdoor heat exchanger 3*b* has an inner pipe 33*a* and an inner pipe 33*b*. As shown in FIG. 15, the inner pipe 33 of the first outdoor heat exchanger 3*a* is connected to the inner pipe 33*a* (see FIG. 15) of the second outdoor heat exchanger 3*b* via the bent inner pipe 33*r* (see FIG. 15). The inside diameter of the inner pipe 33*a* of the second outdoor heat exchanger 3*b* is equal to the inside diameter of the inner pipe 33 of the first outdoor heat exchanger 3*a*. The inner pipe 33*a* is connected to the inner pipe 33*b*. The inside diameter of the inner pipe 33*b* is smaller than the inside diameter of the inner pipe 33*a*. A cap 36 is provided at a terminal end of the inner pipe 33*b*. That is, the inside diameter of the terminal end of the inner pipe 33*b* of the second outdoor heat exchanger 3*b*, at which the cap 36 is provided, is smaller than the inside diameter of a starting end of the inner pipe 33*a* of the second heat exchanger to which the bent inner pipe 33*r* is connected.

The air-conditioning apparatus 100 according to Embodiment 3 makes it possible to prevent the flow pattern from changing from a semi-annular flow to a separated flow due to a decrease in flow rate of refrigerant at a terminal end of the second refrigerant distributor 30*b* of the second outdoor heat exchanger 3*b*. This makes it possible to bring about improvement in flow robustness of refrigerant distribution characteristics.

Although Embodiment 3 has illustrated a case in which the second outdoor heat exchanger 3*b* has the inner pipe 33*a* and the inner pipe 33*b*, the inner pipe 33 of the second outdoor heat exchanger 3*b* may be a pipe whose inside diameter becomes gradually smaller from the starting end toward the terminal end.

Embodiment 4

Embodiment 4 is configured such that a structural part C in which refrigerant flowing through an inner pipe 33 enters an undeveloped state of two-phase gas-liquid flow is provided upstream of the inner pipe 33. Note here that the "undeveloped state of two-phase gas-liquid flow" refers to a state where the refrigerant flowing through the inner pipe 33 is in a state of not being a two-phase gas-liquid flow and in a state of being a stratified flow.

First Example of Structural Part

Figure 19:
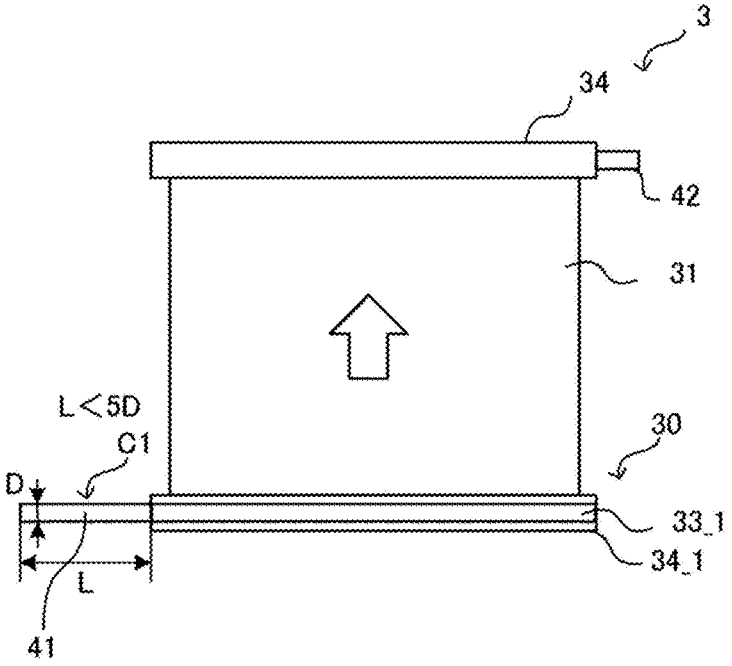
FIG. 19 is a side schematic view of an outdoor heat exchanger according to a first example of an air-conditioning apparatus according to Embodiment 4.

FIG. 19 is a side schematic view of an outdoor heat exchanger 3 according to a first example of an air-conditioning apparatus 100 according to Embodiment 4. FIG. 19 is a diagram showing a structural part C1 of a first example of a refrigerant distributor 30 according to the air-conditioning apparatus 100 according to Embodiment 4.

In FIG. 19, a lower inner pipe 33_1 is provided with a refrigerant outflow hole 35 (not illustrated) at position described in Embodiment 1. Further, a relation of connection between a plurality of heat transfer pipes 31 and a lower outer pipe 34_1 is similar to that of Embodiment 1. Furthermore, an upper outer pipe 34 is provided on top of the plurality of heat transfer pipes 31 and fins 32 (not illustrated). A relation of connection between the upper outer pipe 34 and the plurality of heat transfer pipes 31 is similar to the relation of connection between the lower outer pipe 34_1 and the plurality of heat transfer pipes 31.

At an end of the upper outer pipe 34 through which refrigerant flows out, an outflow pipe 42 whose diameter is smaller than that of the upper outer pipe 34 is provided.

As shown in FIG. 19, the lower inner pipe 33_1 is housed in the lower outer pipe 34_1 and has an upstream side further extended than the lower outer pipe 34_1. The extended portion of the lower inner pipe 33_1 is a linear flow inlet 41 serving as an entrance through which the refrigerant flows into the lower outer pipe 34_1. The flow inlet 41, which is the extended portion of the lower inner pipe 33_1, is also referred to as "structural part C1".

Assuming that D is the inside diameter of the flow inlet 41 and L is the length of the flow inlet 41, $L<10\times D$ holds. It is more desirable that $L<5\times D$ hold.

Refrigerant having passed through such a structural part C1 enters an undeveloped state of two-phase gas-liquid flow, and then flows into the lower inner pipe 33_1. Then, the refrigerant, which is in an undeveloped state of two-phase gas-liquid flow, passes through a refrigerant outflow hole 35 (not illustrated) from the lower inner pipe 33_1, and then flows out to the lower outer pipe 34_1. After having flowed out to the lower outer pipe 34_1, the refrigerant flows into the upper outer pipe 34 through the plurality of heat transfer pipes 31. After having flowed into the upper outer pipe 34, the refrigerant flows into the outflow pipe 42 and flows out of the outdoor heat exchanger 3 through the outflow pipe 42.

Examples of methods for estimating a flow pattern of refrigerant include flow pattern maps such as Baker's maps. Many of these flow pattern maps represent a sufficiently developed state of gas-liquid flow, that is, a pattern of flow in a case in which a sufficient entrance length is provided.

Based on the results of the latest refrigerant visualization experiment conducted by the inventors, it was newly found that flow patterns calculated by Baker's maps or other diagrams obtained by mounting in actual units are not developed in flow and are therefore different from actual flow patterns. Specifically, in many of the cases of annular flow patterns on flow pattern maps, laminar flows and wavy flows were observed. Based on the results of the experimentation conducted by the inventors, this trend was found predominantly when the entrance length of the lower inner pipe 33_1 fell within the range of $L<10\times D$, and was particularly evident in a case in which $L<5D$. Therefore, in a case in which there is no sufficient entrance length upstream of the lower inner pipe 33_1, the refrigerant outflow hole 35 of the lower inner pipe 33_1 is positioned near the interface of a laminar flow or a wavy flow ($\theta=10$ degrees to 80 degrees).

(Effects)

Therefore, the refrigerant distributor 30, which has the structural part C1, of the air-conditioning apparatus 100 according to Embodiment 4 makes it possible to evenly distribute a two-phase gas-liquid flow by providing the lower inner pipe 33_1 with the structural part C1, bringing about improvement in distribution performance.

Second Example of Structural Part

Figure 20:
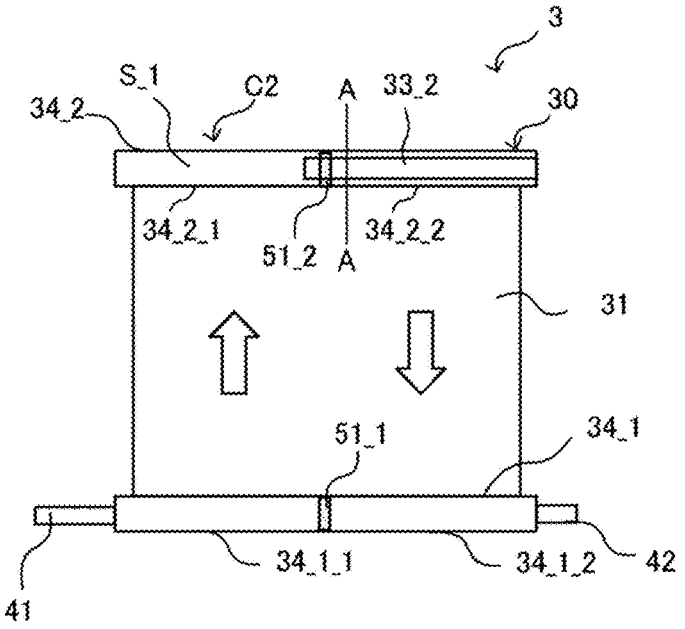
FIG. 20 is a side schematic view of an outdoor heat exchanger according to a second example of the air-conditioning apparatus according to Embodiment 4.

FIG. 20 is a side schematic view of an outdoor heat exchanger 3 according to a second example of the air-conditioning apparatus 100 according to Embodiment 4. FIG. 20 is a diagram showing a structural part C2 of a second example of the refrigerant distributor 30 according to the air-conditioning apparatus 100 according to Embodiment 4.

In FIG. 20, the outdoor heat exchanger 3 has a divider 51_1 provided inside a lower outer pipe 34_1 and a divider 51_2 provided inside an upper outer pipe 34_2 to bring about improvement in velocity of flow of refrigerant and improvement in performance.

As shown in FIG. 20, the divider 51_1 is provided inside the lower outer pipe 34_1. The divider 51_1 divides the interior of the lower outer pipe 34_1 into a lower outer pipe 34_1_1 and a lower outer pipe 34_12 in a direction parallel with an axis of the outer pipe 34_1. At an end of the lower outer pipe 34_1_1 through which refrigerant flows in, a flow inlet 41 whose diameter is smaller than that of the lower outer pipe 34_1_1 is provided. To an outflow side of the lower outer pipe 34_1_2, an outflow pipe 42 whose diameter is smaller than that of the lower outer pipe 34_1_2 is connected.

In FIG. 20, a relation of connection between a plurality of heat transfer pipes 31 and the lower outer pipe 34_1 is similar to that of Embodiment 1. The upper outer pipe 34_2 and an upper inner pipe 33_2 are provided on top of the plurality of heat transfer pipes 31 and fins 32 (not illustrated). A relation of connection between the upper outer pipe 34_2 and the plurality of heat transfer pipes 31 is similar to the relation of connection between the lower outer pipe 34_1 and the plurality of heat transfer pipes 31.

The upper outer pipe 34_2 houses the upper inner pipe 33_2. As in the case of Embodiment 1, the upper inner pipe 33_2 is provided with refrigerant outflow holes 35. The divider 51_2 is provided inside the upper outer pipe 34_2. The divider 51_2 is provided above the divider 51_1, and divides the interior of the upper outer pipe 34_2 into an upper outer pipe 34_2_1 and an upper outer pipe 34_2_2 in a direction parallel with an axis of the outer pipe 24_2. Specifically, the divider 51_2 divides the inner periphery of the upper outer pipe 34_2 and the upper inner pipe 33_2 from each other in a direction parallel with the axis of the outer pipe 24_2.

The upper outer pipe 34_2 is further extended than the upper inner pipe 33_2. The interior of the upper outer pipe 34_2_1 forms a confluence space S_1. To the confluence space S_1, the plurality of heat transfer pipes 31 are connected, and in the confluence space S_1, flows of refrigerant having passed through the flow inlet 41, the lower outer pipe 34_1_1, and the plurality of heat transfer pipes 31 merge with one another.

The confluence space S_1 is also referred to as "structural part C2". The flows of refrigerant having merged with one another in the confluence space S_1 flow into the upper inner pipe 33_2. Further, the flows of refrigerant having merged with one another in the confluence space S_1 partly flow into the upper inner pipe 33_2 after having been turned back by the divider 51_2.

The confluence space S_1 is structured such that assuming that A1 is the flow passage cross-sectional area of the confluence space S_1 and AS is the flow passage cross-sectional area of the upper inner pipe 33_2, A1>AS holds.

Such a structure causes the refrigerant to decrease in two-phase gas-liquid flow when flowing into the upper inner pipe 33_2, which is small in flow passage cross-sectional area, from the confluence space S_1, which is large in flow passage cross-sectional area, but in the confluence space S_1, the refrigerant enters an undeveloped state of two-phase gas-liquid flow.

Figure 21:
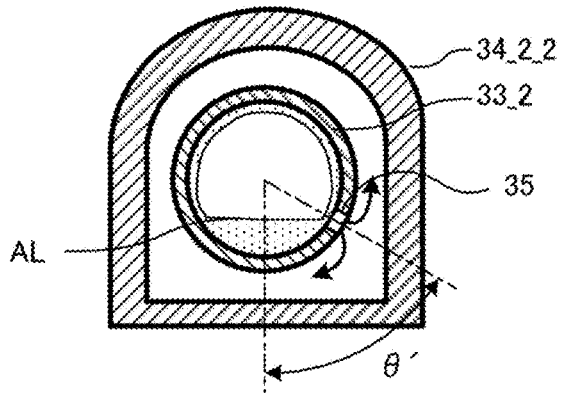
FIG. 21 is a cross-sectional schematic view of upper outer and inner pipes of the outdoor heat exchanger according to the second example of the air-conditioning apparatus according to Embodiment 4 as taken along line A-A in FIG. 20.

FIG. 21 is a cross-sectional schematic view of the upper outer and inner pipes 34_2_2 and 33_2 of the outdoor heat exchanger 3 according to the second example of the air-conditioning apparatus 100 according to Embodiment 4 as taken along line A-A in FIG. 20.

FIG. 21 shows an example in which in the upper inner pipe 33_2, a refrigerant outflow hole 35 is provided at the angle θ' of the liquid surface AL of the liquid-phase refrigerant as in the case of Embodiment 1 described with reference to FIG. 5.

The angle θ' at which the refrigerant outflow hole 35 is provided is an angle between a lower end of the inner pipe 33_2 on a vertical line passing through the center of the inner pipe 33_2 and the position of presence of the refrigerant outflow hole 35 as seen from the center of the inner pipe 33_2, and needs only fall within the range of 10 degrees≤θ'≤80 degrees.

In FIG. 20, refrigerant having flowed out of the refrigerant outflow hole 35 of the upper inner pipe 33_2 passes through the upper outer pipe 34_2_2 and the plurality of heat transfer pipes 31 in sequence and flows into the lower outer pipe 34_1_2. After having flowed into the lower outer pipe 34_1_2, the refrigerant flows into the outflow pipe 42 and flows out of the outdoor heat exchanger 3.

(Effects)

The refrigerant distributor 30, which has the structural part C2, of the air-conditioning apparatus 100 according to Embodiment 4 provides the upper outer pipe 34_2 with the structural part C2. This results in an undeveloped two-phase gas-liquid flow, as the flow passage cross-sectional area A1 of the confluence space S_1 and the flow passage cross-sectional area AS of the upper inner pipe 33_2 are different from each other. As a result, a region where a two-phase gas-liquid flow is undeveloped is formed upstream of the upper inner pipe 33_2. In this case, the refrigerant outflow hole 35 of the upper inner pipe 33_2 is positioned near the interface of a laminar flow or a wavy flow (θ=10 degrees to 80 degrees).

Therefore, the refrigerant distributor 30, which has the structural part C2, of the air-conditioning apparatus 100 according to Embodiment 4 makes it possible to evenly distribute a two-phase gas-liquid flow, bringing about improvement in distribution performance.

Third Example of Structural Part

Figure 22:
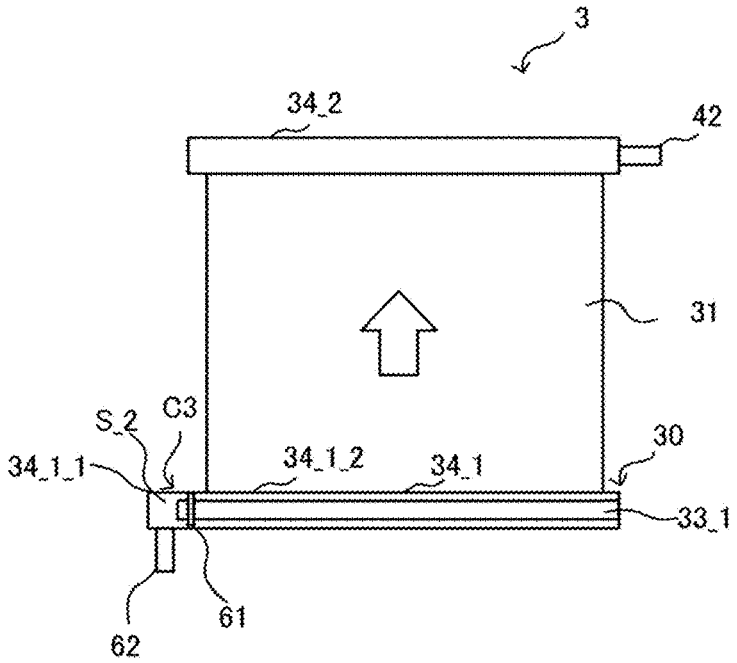
FIG. 22 is a side schematic view of an outdoor heat exchanger according to a third example of the air-conditioning apparatus according to Embodiment 4.

FIG. 22 is a side schematic view of an outdoor heat exchanger 3 according to a third example of the air-conditioning apparatus 100 according to Embodiment 4. FIG. 22 is a diagram showing a structural part C3 of a third example of the refrigerant distributor 30 according to the air-conditioning apparatus 100 according to Embodiment 4.

As shown in FIG. 22, a divider 61 is provided inside a lower outer pipe 34_1. The divider 61 divides the lower outer pipe 34_1 into a lower outer pipe 34_1_1 and a lower outer pipe 34_1_2. Specifically, the divider 61 divides the inner periphery of the lower outer pipe 34_1 and a lower inner pipe 33_1 from each other.

The lower outer pipe 34_1_1 is further extended than the lower inner pipe 33_1. The lower outer pipe 34_1_1 has an opening port (not illustrated) in a lower surface thereof. To the opening port, a refrigerant inflow pipe 62 is connected.

The interior of the lower outer pipe 34_1 constitutes an inflow space S_2. Into the inflow space S_2, refrigerant flows from the refrigerant inflow pipe 62.

The inflow space S_2 is also referred to as "structural part C3". Refrigerant having flowed into the inflow space S_2 flows into the lower inner pipe 33_1.

The inflow space S_2 is structured such that assuming that A2 is the flow passage cross-sectional area of the inflow space S_2 and AS is the flow passage cross-sectional area of the lower inner pipe 33_1, A2>AS holds.

Such a structure causes the refrigerant to decrease in two-phase gas-liquid flow when flowing into the lower inner pipe 33_1, which is small in flow passage cross-sectional area, from the inflow space S_2, which is large in flow passage cross-sectional area, but in the inflow space S_2, the refrigerant enters an undeveloped state of two-phase gas-liquid flow.

In FIG. 22, a relation of connection between a plurality of heat transfer pipes 31 and the lower outer pipe 34_1 is similar to that of Embodiment 1. An upper outer pipe 34_2 is provided on top of the plurality of heat transfer pipes 31 and fins 32 (not illustrated). A relation of connection between the upper outer pipe 34_2 and the plurality of heat transfer pipes 31 is similar to the relation of connection between the lower outer pipe 34_1 and the plurality of heat transfer pipes 31.

At an end of the upper outer pipe 34_2 through which refrigerant flows out, an outflow pipe 42 whose diameter is smaller than that of the upper outer pipe 34_2 is provided.

Refrigerant having flowed into the lower inner pipe 33_1 passes through a refrigerant outflow hole 35 (not illustrated) from the lower inner pipe 33_1, and then flows out to the lower outer pipe 34_1. After having flowed out to the lower outer pipe 34_1, the refrigerant flows into the upper outer pipe 34_2 through the plurality of heat transfer pipes 31. After having flowed into the upper outer pipe 34_2, the refrigerant flows into the outflow pipe 42 and flows out of the outdoor heat exchanger 3.

In this case, the refrigerant outflow hole 35 of the lower inner pipe 33_1 is positioned near the interface of a laminar flow or a wavy flow (θ=10 degrees to 80 degrees).

Although FIG. 22 has illustrated a case in which the refrigerant inflow pipe 62 is provided on the lower surface of the lower outer pipe 34_1_1, the number of refrigerant inflow pipes 62 is not limited to 1. Further, the refrigerant inflow pipe 62 may be fitted, for example, to an upper or side surface of the lower outer pipe 34_1_1.

(Effects)

The refrigerant distributor 30 of the air-conditioning apparatus 100 according to Embodiment 4 has the structural part C3, which is a portion of the lower outer pipe 34_1_1 further extended than the lower inner pipe 33_1, and the structural part C3 has the inflow space S_2. The lower inner pipe 33_1 is housed in and protected by the lower outer pipe 34_1. This makes it unnecessary to increase the thickness of the lower inner pipe 33_1 to ensure strength, making it possible to achieve a reduction in wall thickness of the lower inner pipe 33_1 and savings in space. Further, since the lower inner pipe 33_1 is not exposed to the outside, the wall thickness of the lower inner pipe 33_1 can be reduced.

The refrigerant distributor 30, which has the structural part C3, of the air-conditioning apparatus 100 according to Embodiment 4 brings about an undeveloped state of two-phase gas-liquid flow by providing the lower outer pipe 34_1_1 with the structural part C3, making it possible to evenly distribute the two-phase gas-liquid flow through the inner pipe 33_1. This results in improvement in distribution performance of the refrigerant distributor 30.

Further, connecting the refrigerant inflow pipe 62 to the lower outer pipe 34_1_1 makes it possible to check an increase in piping space resulting from the pipe routing of the refrigerant inflow pipe 62 or other pipes, making it possible to bring about improvement in mountability of the outdoor heat exchanger 3.

Fourth Example of Structural Part

Figure 23:
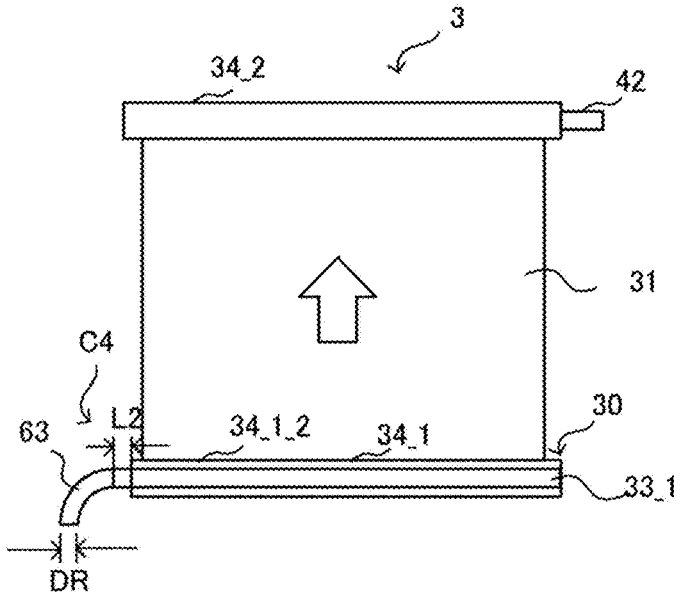
FIG. 23 is a side schematic view of an outdoor heat exchanger according to a fourth example of the air-conditioning apparatus according to Embodiment 4.

FIG. 23 is a side schematic view of an outdoor heat exchanger 3 according to a fourth example of the air-conditioning apparatus 100 according to Embodiment 4. FIG. 23 is a diagram showing a structural part C4 of a fourth example of the refrigerant distributor 30 according to the air-conditioning apparatus 100 according to Embodiment 4.

In FIG. 23, a lower inner pipe 33_1 is provided with a refrigerant outflow hole 35 (not illustrated) at position described in Embodiment 1. Further, a relation of connection between a plurality of heat transfer pipes 31 and a lower outer pipe 34_1 is similar to that of Embodiment 1. Furthermore, an upper outer pipe 34_2 is provided on top of the plurality of heat transfer pipes 31 and fins 32 (not illustrated). A relation of connection between the upper outer pipe 34_2 and the plurality of heat transfer pipes 31 is similar to the relation of connection between the lower outer pipe 34_1 and the plurality of heat transfer pipes 31.

At an end of the upper outer pipe 34_2 through which refrigerant flows out, an outflow pipe 42 whose diameter is smaller than that of the upper outer pipe 34_2 is provided.

As shown in FIG. 23, the lower inner pipe 33_1 is housed in the lower outer pipe 34_1 and has an upstream side further extended than the lower outer pipe 34_1. An extended portion of the lower inner pipe 33_1 is linear. Furthermore, a bent inflow pipe 63 is provided upstream of the extended linear portion of the lower inner pipe 33_1. The bent inflow pipe 63 is also referred to as "structural part C4".

Assuming that DR is the flow passage inside diameter of the bent inflow pipe 63 and L2 is the length of the linear portion of the lower inner pipe 33_1 further extended than the outer pipe 34_1_2, $L2<5\times DR$ holds.

Refrigerant having passed through such a structural part C4 enters an undeveloped state of two-phase gas-liquid flow. Then, the refrigerant, which is in an undeveloped state of two-phase gas-liquid flow, flows into the lower inner pipe 33_1. After having flowed into the lower inner pipe 33_1, the refrigerant passes through the refrigerant outflow hole 35 (not illustrated) from the lower inner pipe 33_1, and then flows out to the lower outer pipe 34_1. After having flowed out to the lower outer pipe 34_1, the refrigerant flows into the upper outer pipe 34_2 through the plurality of heat transfer pipes 31. After having flowed into the upper outer pipe 34_2, the refrigerant flows into the outflow pipe 42 and flows out of the outdoor heat exchanger 3.

In this case, the refrigerant outflow hole 35 of the lower inner pipe 33_1 is positioned near the interface of a laminar flow or a wavy flow (θ=10 degrees to 80 degrees).

Although FIG. 23 has illustrated a case in which the lower inner pipe 33_1 is provided with the bent inflow pipe 63, the bent inflow pipe 63 may be formed by bending part of the lower inner pipe 33_1.

(Effects)

The refrigerant distributor 30, which has the structural part C4, of the air-conditioning apparatus 100 according to Embodiment 4 subjects gas-liquid refrigerant flowing through the bent inflow pipe 63 to centrifugal force by providing the bent inflow pipe 63. This causes the refrigerant flowing through the bent inflow pipe 63 to enter an undeveloped state of two-phase gas-liquid flow.

Therefore, the refrigerant distributor 30, which has the structural part C4, of the air-conditioning apparatus 100 according to Embodiment 4 makes it possible to evenly distribute a two-phase gas-liquid flow by providing the lower outer pipe 34_1 with the structural part C4, bringing about improvement in distribution performance.

Embodiment 5

Providing the structural parts C1 to C4 described in Embodiment 4 causes refrigerant flowing into the inner pipe 33 to enter an undeveloped state of two-phase gas-liquid flow. As a result of the inventors' analysis, they found a more appropriate angle of a refrigerant outflow hole 35 in this case. Embodiment 5 is intended to define a more appropriate angle φ of a refrigerant outflow hole 35 in the case of an undeveloped state of two-phase gas-liquid flow. The angle φ is an angle between a lower end of the inner pipe 33 on a vertical line passing through the center of the inner pipe 33 and the position of presence of the refrigerant outflow hole 35 as seen from the center of the inner pipe 33.

Figure 24:
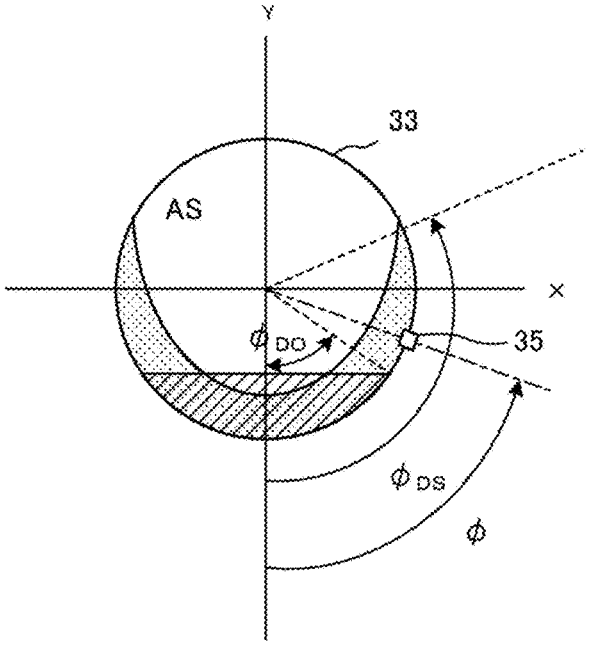
FIG. 24 is a diagram showing the angle of a refrigerant outflow hole in an inner pipe in an air-conditioning apparatus according to Embodiment 5.

FIG. 24 is a diagram showing the angle φ of a refrigerant outflow hole 35 in an inner pipe 33 in an air-conditioning apparatus 100 according to Embodiment 5.

In FIG. 24, φ is the optimum angle of the refrigerant outflow hole 35, $\varphi_{D0}$ is the liquid-surface angle in a case in which it is assumed that the gas-liquid slip ratio of the refrigerant is 1 and the gas-liquid interface of the refrigerant is flat and horizontal, $\varphi_{DS}$ is the wetting boundary angle in a pipe circumferential direction that is used, for example, in the prediction of an evaporative transfer coefficient in consideration of the gas-liquid slip ratio and inertial force of the refrigerant, and AS is the flow passage cross-sectional area of the inner pipe 33.

In a case in which $\varphi_{DS}$ is defined as the liquid-surface angle of a flow pattern, the angle φ of the refrigerant outflow hole 35 is expressed as $\varphi_{D0}<\varphi<\varphi_{DS}$.

Note here that $\varphi_{D0}$ and $\varphi_{DS}$ are computed according to Formulas (5) and (6), respectively, using Formulas (2) to (4) for liquid surface angle, proposed by Mori et al., that are used in the prediction of the evaporative heat transfer coefficient of a horizontal smooth pipe.

[Math. 2]

$$\frac{1}{1+\left(\frac{1-x}{x}\right)\left(\frac{\rho_G}{\rho_L}\right)} = 1 - \frac{\varphi_0 - \sin\varphi_0\cos\varphi_0}{\pi} \tag{2}$$

[Math. 3]

$$\phi_S = \left[1 + 0.72\left[\left(\frac{x}{1-x}\right)\left(\frac{\rho_L}{\rho_G}\right)^{0.5}\right]^n\left(\frac{\rho_L}{\rho_G}\right)^{0.17}\right]\varphi_0 \tag{3}$$

[Math. 4]

$$n = 0.22\left[\frac{G^2}{gD\rho_G(\rho_L-\rho_G)}\right]^{0.38}\left(\frac{q}{G\Delta h_G}\times 10^4\right)^{-0.06}\left(\frac{gD}{\Delta h_G}\times 10^3\right)^{-0.27} \tag{4}$$

[Math. 5]

$$\varphi_{D0} = \varphi_0 \times \frac{180}{\pi} \tag{5}$$

[Math. 6]

$$\varphi_{DS} = \varphi_S \times \frac{180}{\pi} \tag{6}$$

Note here that the variables in the formulas are as follows and the refrigerant quality, the densities, the mass velocity, the latent heat, or other variables represent values measured at the inlet of the inner pipe 33. Further, in the inner pipe 33, the thermal flow rate takes on a sufficiently small value of q=0.001. Further, the mass velocity is defined as $G=(M\times 3600)/\{(D/2)^2\times\pi\}$, where M [kg/h] is the refrigerant mass flow rate and d [m] is the inside diameter of the inner pipe 33. Further, the quantifies of state of the refrigerant such as the densities and the evaporative latent heat can be estimated, for example, by using a common table of physical property values and the physical property calculation software "Refprop".

x: Refrigerant quality [-],
$\rho_G$: Refrigerant gas density [kg/m$^3$],
$\rho_L$: Refrigerant liquid density [kg/m$^3$],
G: Mass velocity [kg/(m$^2$s)],
D: Inside diameter of inner pipe 33 [m],
g: Gravitational acceleration [m/s$^2$],
$\Delta h_G$: Evaporative latent heat [kJ/kg],
q: Intratubular surface circumference average thermal flow rate [kW/m$^2$]

The wetting boundary angle $\varphi_{DS}$ in a pipe circumferential direction as calculated by the formulas of Mori et al. is a boundary angle with a very thin region taken into account, as the formulas are formulas obtained by an analysis based on a measurement database of heat transfer coefficients and a heat transfer coefficient is high in heat transfer coefficient contribution in a very thin liquid film region. On the other hand, the angle φ of optimum distribution of a refrigerant outflow hole 35 at which to achieve appropriate distribution in refrigerant distribution should be an angle that is smaller than a portion in which the liquid film is thick to some extent, that is, $\varphi_{DS}$. Further, this angle φ of optimum distribution is present at an angle that is larger than the liquid-surface angle $\varphi_{D0}$ in a case in which, as shown in FIG. 24, it is virtually assumed that the gas-liquid slip ratio is 1 and the gas-liquid interface is flat and horizontal.

According to the comparison results of the analysis conducted by the inventors using Formulas (2) to (6) and the refrigerant visualization experiment, it is found that the angle φ of optimum distribution is nearly equal to $1.5\varphi_{D0}$. Further, it is found that although the angle of the liquid surface is particularly dominantly affected by the quality of refrigerant, although the angle of the liquid surface is affected by the flow rate and quality of refrigerant and the gas-liquid density ratio. Assume the maximum flow under a representative condition of heating rated operation in the range of 0.05 to 0.80, which highly frequently occurs as the evaporator inlet quality of common air-conditioning equipment. It is found that in this case, the optimum distribution angle is present in the range of 80 degrees to 10 degrees and an increase in quality leads to a decrease in optimum distribution angle.

Further, Formulas (6) and (7) are $\varphi_{D0}$ and $\varphi_{DS}$ prediction formulas obtained by the analysis conducted by the inventors using Formulas (2) to (6). Formulas (6) and (7) represent a relationship between the flow passage cross-sectional area AS [mm$^2$] of the inner pipe 33, which is a dominant shape parameter of the inner pipe 33 in a case in which the flow condition of refrigerant during heating rated operation common to air-conditioning equipment is taken into account as a representative condition, and the angle φ of optimum distribution. When the angle φ of optimum distribution satisfies $\varphi_{D0}<\varphi<\varphi_{DS}$, the distribution performance of the inner pipe 33 can be improved.

[Math. 7]

$$\phi_{D0}=(-0.0408\times AS+74.124)\times 0.62 \tag{7}$$

[Math. 8]

$$\phi_{DS}=(-0.0408\times AS+74.124)\times 1.2 \tag{8}$$

Therefore, the refrigerant distributor 30 of the air-conditioning apparatus 100 according to Embodiment 5 makes it possible to place the angle φ of a refrigerant outflow hole 35 at more appropriate position, thus making it possible to more evenly distribute refrigerant.

Embodiment 6

Figure 25:
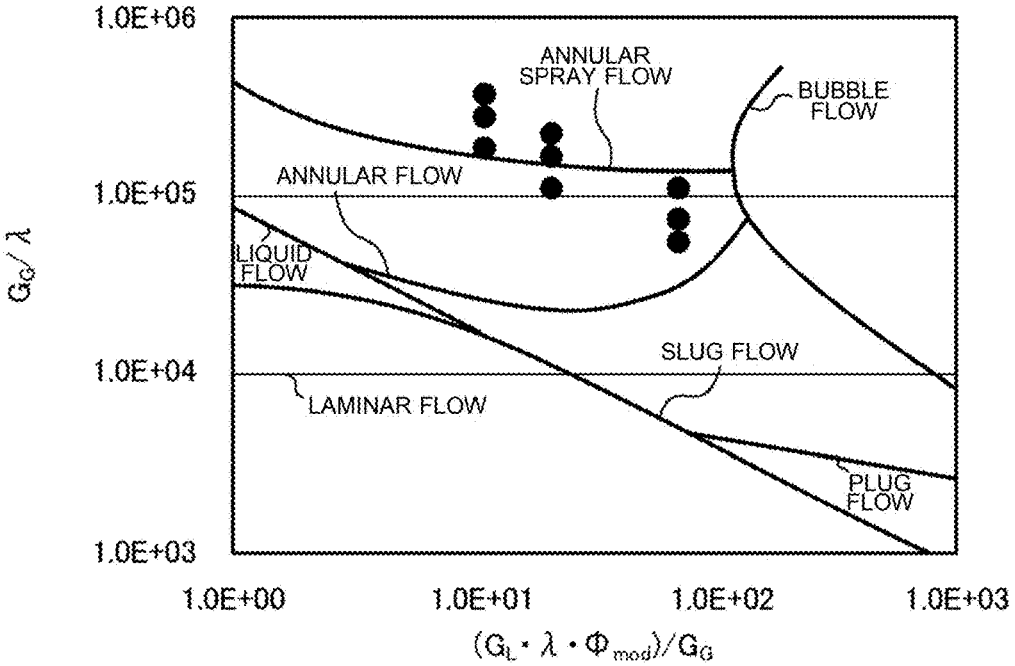
FIG. 25 is a diagram showing a flow pattern map (Bakers map) drawn by plotting flow conditions of the refrigerant inside the inner pipes under conditions of experimentation conducted by the inventors on the refrigerant in the distributors according to Embodiments 1 to 5.

FIG. 25 is a diagram showing a flow pattern map (Baker's map) drawn by plotting flow conditions of the refrigerant inside the inner pipes 33 under conditions of experimentation conducted by the inventors on the refrigerant in the distributors according to Embodiments 1 to 5.

The inventors attempted to reduce imbalances in liquid phases due to the internal gravities of the inner pipes 33 by designing the inside diameters of the inner pipes 33 to attain a flow condition for an annular flow or an annular spray flow on the Baker's map.

However, it was confirmed by the refrigerant visualization experiment that even under conditions of an annular flow and an annular spray flow on a flow pattern map as shown in FIG. 25, the refrigerant actually flows in a wavy flow or a laminar flow.

This is presumably due to the fact that many flow pattern maps such as Baker's maps are often constructed based on water-air experiments with sufficient entrance lengths. As a result of the refrigerant visualization experiment conducted by the inventors, it was found that under conditions for the maximum flows of refrigerant flowing through the heat exchangers, the flows often became undeveloped and laminar, provided the inside diameters D [m] of the inner pipes 33 fell within the range of D $D_A/6$, where $D_A$ [m] is the inside diameter of an inner pipe 33 within a range of an annular flow, an annular spray flow, and a slug flow on the Bakers map.

As a result, it was made clear based on the refrigerant visualization experiment that an actual flow pattern can be largely predicated by modifying a Baker's flow pattern map and causing an inner pipe 33 to have an inside diameter D of $D_A/6$.

Figure 26:
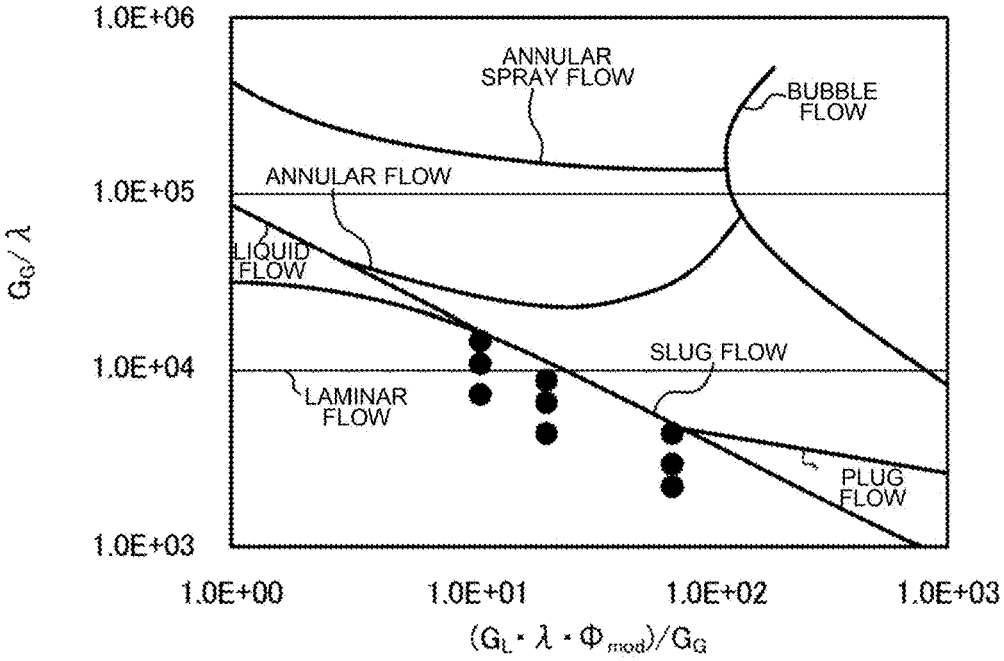
FIG. 26 is a diagram showing a modified Bakers flow pattern map drawn in Embodiment 6 under refrigerant inflow conditions that are identical to those of FIG. 25.

FIG. 26 is a diagram showing a modified Baker's flow pattern map drawn in Embodiment 6 under refrigerant inflow conditions that are identical to those of FIG. 25. In FIG. 26, the inside diameter of the inner pipe 33 is $D_A/6$. As shown in FIG. 26, it is confirmed that the conditions of an annular flow and an annular spray flow on the Baker's flow pattern map shown in FIG. 25 are laminar flows and the flow pattern of refrigerant as observed by the actual refrigerant visualization largely agrees with the flow pattern of refrigerant shown in FIG. 26. Therefore, with the inside diameter of the inner pipe 33 being $D \geq D_A/6$, a flow of refrigerant inside becomes undeveloped and laminar as in the cases of Embodiments 1 to 5. Therefore, for example, the distribution performance of a two-phase gas-liquid flow can be improved by positioning the refrigerant outflow holes 35 of the lower inner pipe 33_1 near the interface (θ=10 degrees to 80 degrees) of a laminar flow or a wavy flow.

It should be noted that the horizontal axis of the Bakers map is $(G_L \times \lambda \times \varphi_{mod})/G_G$ and the vertical axis is $G_G/\lambda$, and that $G_G=W_G/A_m$, $G_L=W_L/A_m$, $W_G=W \times x$, $W_L=W \times (1-x)$, and $A_m=(D/2)^2 \times \pi$, where $G_L$ is the liquid-phase mass velocity [kg/m$^2$s], $G_G$ is the gas-phase mass velocity [kg/m$^2$s], $W_L$ is the liquid-phase mass flow rate [kg/s], $W_G$ is the gas-phase mass flow rate [kg/s], $A_m$ is the flow passage cross-sectional area of the inner pipe 33 [m$^2$], x is the quality [-], ρ is the density [kg/m$^3$], μ is the coefficient of viscosity [Pa·s], and σ is the surface tension [N/m].

[Math. 9]

$$\lambda = \left[\left(\frac{\rho_G}{\rho_A}\right)\left(\frac{\rho_L}{\rho_W}\right)\right]^{1/2} \tag{9}$$

[Math. 10]

$$\phi_{mod} = \frac{\sigma_W}{\sigma}\left[\frac{\mu_L}{\mu_W}\left(\frac{\rho_W}{\rho_L}\right)^2\right]^{1/3} \tag{10}$$

The values followed by the subscripts A and W are the values of the physical properties of air and water, respectively, at 20 degrees C. under atmospheric pressures, and aw is the air-water surface tension in this state.

Further, according to the refrigerant visualization experiment conducted by the inventors using common fluorocarbon refrigerant, it was found that the refrigerant flows in a laminar flow under most flow conditions with the flow passage cross-sectional area AS of the inner pipe 33 being equal to 31.6 mm$^2$ to 201.1 mm$^2$ and that positioning the refrigerant outflow holes 35 at an angle near the liquid surface AL (θ=10 degrees to 80 degrees) as shown in Embodiments 1 to 5 is particularly highly effective in improving imbalances in distribution.

Figure 27:
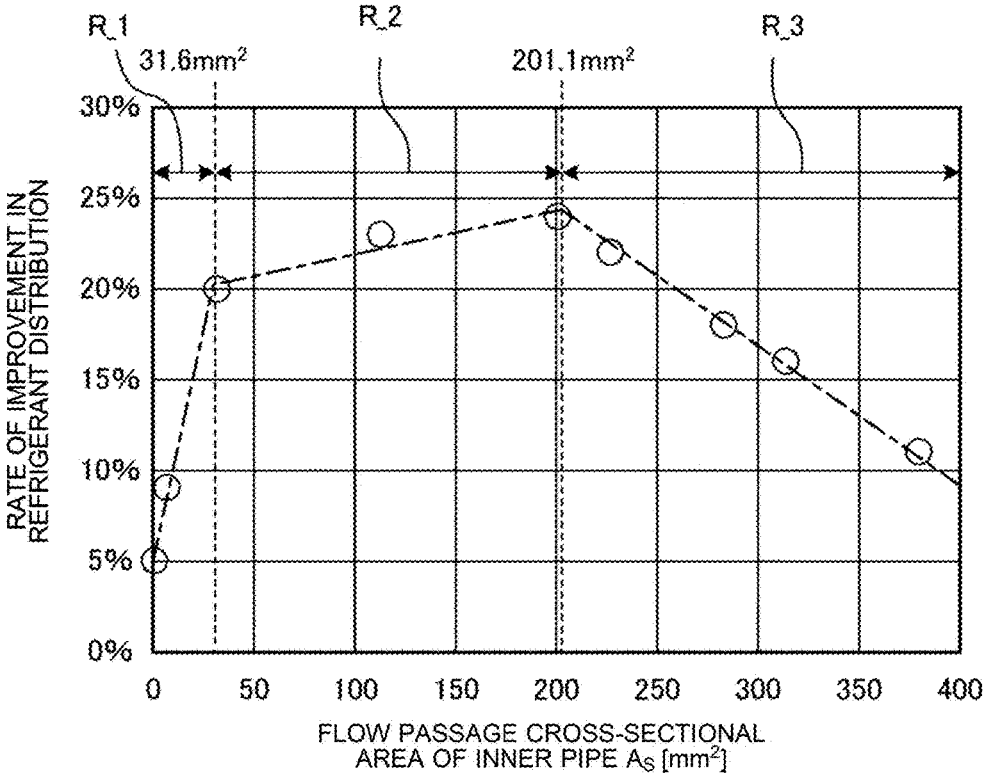
FIG. 27 is a diagram showing a relationship between the flow passage cross-sectional area of an inner pipe and the rate of improvement in refrigerant distribution brought about by a refrigerant outflow hole in Embodiment 6.

FIG. 27 is a diagram showing a relationship between the flow passage cross-sectional area AS of the inner pipe 33 and the rate of improvement in refrigerant distribution brought about by the refrigerant outflow holes 35 in Embodiment 6. As shown in FIG. 27, in the region R_1, where 0<AS<31.6 mm$^2$, the refrigerant easily undergoes transition in flow pattern to an annular flow in many cases, so that the effect of improvement in distribution brought about by the angle of the refrigerant outflow holes 35 is low.

Meanwhile, in the region R_2, where 31.6 mm$^2$≤AS≤201.1 mm$^2$, the effect of improvement in distribution is high, as it is a region of undeveloped flow patterns of wavy and laminar flows. In the region R_3, where AS>201.1 mm$^2$, the flow passage cross-sectional area of the inner pipe 33 is large for a heat exchanger that is used in common air-conditioning equipment, so that there are tendencies turning toward a decrease in the inertial force and deterioration in distribution. This leads to a decrease in the effect of improvement in distribution.

Embodiment 7

Figure 28:
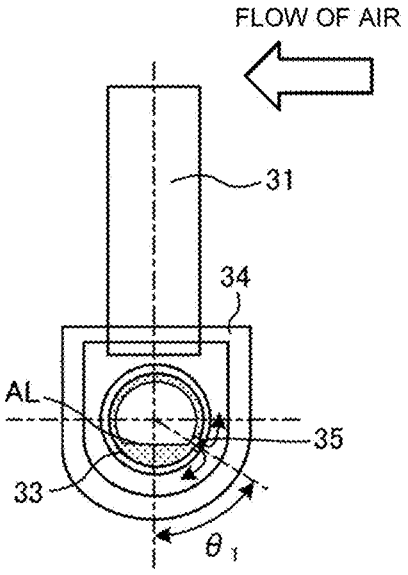
FIG. 28 is a vertical cross-sectional view of a refrigerant distributor of an air-conditioning apparatus according to Embodiment 7.

FIG. 28 is a vertical cross-sectional view of a refrigerant distributor 30 of an air-conditioning apparatus 100 according to Embodiment 7.

In each of Embodiments 1 to 6, the angle θ1 of a refrigerant outflow hole 35 is not limited to particular orientations, and the effect of improvement in distribution can be brought about by positioning the refrigerant outflow hole 35 near the liquid surface AL. On the other hand, in Embodiment 7, the orientation of the angle θ1 of a refrigerant outflow hole 35 at which the refrigerant distributor 30 is mounted in a heat exchanger, that is, the direction of opening of the refrigerant outflow hole 35, is set as follows. Specifically, in a case in which the refrigerant distributor 30 is mounted in a heat exchanger, the refrigerant outflow hole 35 is provided at position on a windward side of the refrigerant distributor 30 and in a range near the liquid surface AL (θ=10 degrees to 80 degrees). Doing so makes it possible to distribute much liquid refrigerant to a region where there are great differences in temperature among flat tubes.

The embodiments are presented as examples, and are not intended to limit the scope of claims. The embodiments may be carried out in other various forms, and various omissions, substitutions, and changes can be made without departing from the spirit of the embodiments. These embodiments and modifications thereof are encompassed in the scope and spirit of the embodiments.

REFERENCE SIGNS LIST

1: compressor, 2: four-way valve, 3: outdoor heat exchanger, 3*a*: first outdoor heat exchanger, 3*b*: second outdoor heat exchanger, 4: fan, 5: expansion valve, 6: indoor heat exchanger, 7: fan, 8: accumulator, 10: outdoor unit, 11, 12, 13: indoor unit, 26, 27: refrigerant pipe, 30: refrigerant distributor, 30*a*: first refrigerant distributor, 30*b*: second refrigerant distributor, 31: heat transfer pipe, 32: fin, 33, 33*a*, 33*b*, 33_2: inner pipe, 33*r* bent inner pipe, 34, 34_1, 34_1_1, 34_1_2, 34_2_1, 34_2_2: outer pipe, 35: refrigerant outflow hole, 36: cap: 41: flow inlet, 42: outflow pipe, 51_1, 51_2, 61: divider, 62: refrigerant inflow pipe, 63: bent inflow pipe, 100: air-conditioning apparatus, AL: liquid surface, C, C1 to C4: structural part, L: length of extended inner pipe, D: inside diameter of extended inner pipe, A1: flow passage cross-sectional area of confluence space, A2: flow passage cross-sectional area of inflow space, AS: flow passage cross-sectional area of inner pipe, DR: flow passage inside diameter of bent inflow pipe, L2: length of linear portion of inner pipe extended, poo: liquid-surface angle, $\varphi_{Ds}$: liquid-surface angle, θ, φ, θ1: angle of refrigerant outflow hole, θ: angle of liquid surface, R_1, R_2, R_3: region, S_1: confluence space, S_2: inflow space

The invention claimed is:

1. A refrigerant distributor comprising:

an outer pipe through which refrigerant flows and to which a plurality of heat transfer pipes are connected at a predetermined spacing from each other;

an inner pipe, housed in the outer pipe, through which the refrigerant flows and that has a refrigerant outflow hole through which the refrigerant flows out of the inner pipe into the outer pipe; and a structural part with which the inner pipe or the outer pipe is provided, in which the refrigerant enters an undeveloped state of two-phase gas-liquid flow, and through which the refrigerant flows into the inner pipe, wherein the refrigerant outflow hole is provided such that an angle θ between a lower end of the inner pipe on a vertical line passing through a center of the inner pipe and a position of presence of the refrigerant outflow hole as seen from the center of the inner pipe falls within a range of 10 degrees≤θ≤80 degrees, the refrigerant outflow hole comprises a sole refrigerant outflow hole provided in a vertical cross-section of the inner pipe at a position where the refrigerant outflow hole is provided, the inner pipe is further linearly extended than the outer pipe, the structural part is the inner pipe thus extended, and L<10×D, where D is an inside diameter of an extended portion of the inner pipe and L is a length of the extended portion of the inner pipe.

2. The refrigerant distributor of claim 1, wherein the refrigerant outflow hole is one of a plurality of refrigerant outflow holes, and each refrigerant outflow hole of the plurality of refrigerant outflow holes is provided between one of the heat transfer pipes of the plurality of heat transfer pipes and an adjacent one of the heat transfer pipes of the plurality of heat transfer pipes.

3. A heat exchanger comprising the refrigerant distributor of claim 1.

4. An air-conditioning apparatus comprising the heat exchanger of claim 3.

5. The refrigerant distributor of claim 1, wherein AS=31.6 $mm^2$ to 201.1 $mm^2$, where AS [$mm^2$] is a flow passage cross-sectional area of the inner pipe.

6. A refrigerant distributor comprising:

an outer pipe through which refrigerant flows and to which a plurality of heat transfer pipes are connected at a predetermined spacing from each other;

an inner pipe, housed in the outer pipe, through which the refrigerant flows and that has a refrigerant outflow hole through which the refrigerant flows out of the inner pipe into the outer pipe, and a structural part with which the inner pipe or the outer pipe is provided, in which the refrigerant enters an undeveloped state of two-phase gas-liquid flow, and through which the refrigerant flows into the inner pipe, wherein the refrigerant outflow hole is such that an angle between a lower end of the inner pipe on a vertical line passing through a center of the inner pipe and a position of presence of the refrigerant outflow hole as seen from the center of the inner pipe satisfies $\varphi_{D0}<\theta<\varphi_{DS}$, where $\varphi_{D0}=(-0.0408\times AS+74.124)\times 0.62$, $\varphi_{Ds}=(-0.0408\times AS+74.124)\times 1.2$, and AS [$mm^2$] is a flow passage cross-sectional area of the inner pipe, the outer pipe is further extended than the inner pipe and includes a divider configured to divide an inner periphery of the outer pipe and an outer periphery of the inner pipe from each other in a direction parallel with an axis of the outer pipe, and the structural part is a confluence space, provided in the outer pipe thus extended, in which flows of refrigerant from the plurality of heat transfer pipes in an interior of the outer pipe divided by the divider merge with one another.

7. The refrigerant distributor of claim 6, wherein the refrigerant outflow hole is one of a plurality of refrigerant outflow holes, and each refrigerant outflow hole of the plurality of refrigerant outflow holes is provided between one of the heat transfer pipes of the plurality of heat transfer pipes and an adjacent one of the heat transfer pipes of the plurality of heat transfer pipes.

8. A refrigerant distributor comprising:

an outer pipe through which refrigerant flows and to which a plurality of heat transfer pipes are connected at a predetermined spacing from each other;

an inner pipe, housed in the outer pipe, through which the refrigerant flows and that has a refrigerant outflow hole through which the refrigerant flows out of the inner pipe into the outer pipe; and a structural part with which the inner pipe or the outer pipe is provided, in which the refrigerant enters an undeveloped state of two-phase gas-liquid flow, and through which the refrigerant flows into the inner pipe, wherein the refrigerant outflow hole is provided such that an angle θ between a lower end of the inner pipe on a vertical line passing through a center of the inner pipe and a position of presence of the refrigerant outflow hole as seen from the center of the inner pipe falls within a range of 10 degrees≤θ≤80 degrees, and the refrigerant outflow hole comprises a sole refrigerant outflow hole provided in a vertical cross-section of the inner pipe at a position where the refrigerant outflow hole is provided, the refrigerant distributor comprises a first refrigerant distributor and a second refrigerant distributor, an inner pipe of the first refrigerant distributor and an inner pipe of the second refrigerant distributor are connected by a bent inner pipe, and an angle θ2 of the refrigerant outflow hole of the second refrigerant distributor is larger in absolute value within a range of −180 degrees to 180 degrees than an angle θ1 of the refrigerant outflow hole of the first refrigerant distributor.

9. The refrigerant distributor of claim 8, wherein an inside diameter of a terminal end of the inner pipe of the second refrigerant distributor at which a cap is provided is smaller than an inside diameter of a starting end of the inner pipe of the second refrigerant distributor connected to the bent inner pipe.

10. A refrigerant distributor comprising:

an outer pipe through which refrigerant flows and to which a plurality of heat transfer pipes are connected at a predetermined spacing from each other;

an inner pipe, housed in the outer pipe, through which the refrigerant flows and that has a refrigerant outflow hole through which the refrigerant flows out of the inner pipe into the outer pipe; and a structural part with which the inner pipe or the outer pipe is provided, in which the refrigerant enters an undeveloped state of two-phase gas-liquid flow, and through which the refrigerant flows into the inner pipe, wherein the refrigerant outflow hole is provided such that an angle θ between a lower end of the inner pipe on a vertical line passing through a center of the inner pipe and a position of presence of the refrigerant outflow hole as seen from the center of the inner pipe falls within a range of 10 degrees≤θ≤80 degrees, the refrigerant outflow hole comprises a sole refrigerant outflow hole provided in a vertical cross-section of the inner pipe at a position where the refrigerant outflow hole is provided, the outer pipe is further extended than the inner pipe and includes a divider configured to divide an inner periphery of the outer pipe and an outer periphery of the inner pipe from each other, the structural part is the outer pipe thus extended, and the outer pipe thus extended has an inflow space through which the refrigerant flows into an interior of the outer pipe divided by the divider.

11. A refrigerant distributor comprising:

an outer pipe through which refrigerant flows and to which a plurality of heat transfer pipes are connected at a predetermined spacing from each other;

an inner pipe, housed in the outer pipe, through which the refrigerant flows and that has a refrigerant outflow hole through which the refrigerant flows out of the inner pipe into the outer pipe, and a structural part with which the inner pipe or the outer pipe is provided, in which the refrigerant enters an undeveloped state of two-phase gas-liquid flow, and through which the refrigerant flows into the inner pipe, wherein the refrigerant outflow hole is such that an angle between a lower end of the inner pipe on a vertical line passing through a center of the inner pipe and a position of presence of the refrigerant outflow hole as seen from the center of the inner pipe satisfies $\varphi_{D0}<\theta<\varphi_{DS}$, where $\varphi_{D0}=(-0.0408\times AS+74.124)\times 0.62$, $\varphi_{Ds}=(-0.0408\times AS+74.124)\times 1.2$, and AS [$mm^2$] is a flow passage cross-sectional area of the inner pipe, the inner pipe is further linearly extended than the outer pipe, the structural part is the inner pipe thus extended, and $L<10\times D$, where D is an inside diameter of an extended portion of the inner pipe and L is a length of the extended portion of the inner pipe.

* * * * *